US007061463B2

(12) United States Patent
Crossland et al.

(10) Patent No.: US 7,061,463 B2
(45) Date of Patent: Jun. 13, 2006

(54) ADDRESSING TECHNIQUE FOR AN ACTIVE BACKPLANE DEVICE

(75) Inventors: William A Crossland, Cambridge (GB); Tat CB Yu, Cambridge (GB)

(73) Assignee: QinetiQ Limited, Farnborough Hants (GB)

( * ) Notice: Subject to any disclaimer, the term of this patent is extended or adjusted under 35 U.S.C. 154(b) by 715 days.

(21) Appl. No.: 10/094,958

(22) Filed: Mar. 12, 2002
(Under 37 CFR 1.47)

(65) Prior Publication Data

US 2003/0174117 A1 Sep. 18, 2003

Related U.S. Application Data

(63) Continuation of application No. 09/868,218, filed on Jun. 15, 2001, now abandoned.

(30) Foreign Application Priority Data

Dec. 19, 1998 (GB) ..... 9827964.9

(51) Int. Cl.
*G09G 3/36* (2006.01)

(52) U.S. Cl. ..... 345/97; 345/92

(58) Field of Classification Search ..... 345/84, 345/87, 90, 92, 97, 98, 100, 103, 95, 10, 345/94; 348/770, 771, 774
See application file for complete search history.

(56) References Cited

U.S. PATENT DOCUMENTS

| | | | | |
|---|---|---|---|---|
| 4,822,142 | A * | 4/1989 | Yasui | 349/48 |
| 4,872,002 | A * | 10/1989 | Stewart et al. | 345/55 |
| 5,073,010 | A * | 12/1991 | Johnson et al. | 349/28 |
| 5,179,371 | A * | 1/1993 | Yamazaki | 345/93 |
| 5,568,163 | A * | 10/1996 | Okumura | 345/100 |
| 5,751,266 | A * | 5/1998 | Crossland et al. | 345/96 |
| 6,175,352 | B1 * | 1/2001 | Kay et al. | 345/100 |

FOREIGN PATENT DOCUMENTS

| | | |
|---|---|---|
| EP | 0 324 204 | 7/1989 |
| EP | 0 821 338 | 1/1998 |

* cited by examiner

*Primary Examiner*—Kent Chang
(74) *Attorney, Agent, or Firm*—Nixon & Vanderhye P.C.

(57) ABSTRACT

An active semiconductor backplane for a matrix liquid crystal display comprises a plurality of mutually exclusive sets of electrically-addressable elements defining a pixel array. Scanning circuitry addresses the sets one at a time. Set selection circuitry addresses more than one of the plurality of sets simultaneously. Preferably, the sets are simultaneously addressable rows for fast blanking. Single pass and two-pass schemes for writing and re-writing the array are described.

37 Claims, 14 Drawing Sheets

| NSAR | NCO | CCO |
|---|---|---|
| 0 | 0 | 1 |
| 0 | 1 | 1 |
| 1 | 0 | 1 |
| 1 | 1 | 0 |

(a)

| NISE | NCO | CRO |
|---|---|---|
| 0 | 0 | 1 |
| 0 | 1 | 0 |
| 1 | 0 | 0 |
| 1 | 1 | 0 |

(b)

| NSAR | NC2 | NCR2' |
|---|---|---|
| 0 | 0 | 1 |
| 0 | 1 | 1 |
| 1 | 0 | 0 |
| 1 | 1 | 1 |

(c)

| NSAR | SAR |
|---|---|
| 0 | 1 |
| 1 | 0 |

ADDRESSING TECHNIQUE FOR AN ACTIVE BACKPLANE DEVICE

This application is a continuation of application Ser. No. 09/868,218, filed Jun. 15, 2001 now abandoned, the entire content of which is hereby incorporated by reference in this application.

TECHNICAL FIELD

The present invention relates to addis sable arrays, and to spatial light modulators incorporating such arrays.

BACKGROUND

The spatial light modulator to be described in relation to a preferred embodiment in this specification is a in the form of a smectic liquid crystal layer disposed between an active semiconductor backplane and a common front electrode. It was developed in response to a requirement for a fast and, if possible, inexpensive, spatial light modulator comprising a relatively large number of pixels with potential application not only as a display device, but also for other forms of optical processing such as correlation and holographic switching. Other aspects of this device are dealt with in our copending International Patent Applications of even filing and priority dates (PCT/GB99/04285, and corresponding U.S. application Ser. No. 09/868,219, now U.S. Pat. No. 6,864,944; PCT/GB99/04286 and corresponding U.S. application Ser. No. 09/868,232; PCT/GB99/04276, and corresponding U.S. application Ser. No. 09/868,220, now U.S. Pat. No. 6,690,444; PCT/GB99/04282, and corresponding U.S. application Ser. No. 09/446,325, now U.S. Pat. No. 6,389,187 and 10/084,652; PCT/GB99/04279, and corresponding U.S. application Ser. No. 09/868,229, now U.S. Pat. No. 6,812,909 and Ser. No. 10/085,140; PCT/GB99/04275, and corresponding U.S. application Ser. No. 09/868,217, now U.S. Pat. No. 6,762,873; and PCT/GB99/04260 and corresponding U.S. application Ser. No. 09/868,241 and PCT/GB99/04277, and corresponding U.S. application Ser. No. 09/868,242.

During the course of development of this spatial light modulator, a series of problems were encountered and dealt with, and the solutions to these problems (whether in the form of construction, function or method) are not necessarily restricted in application to the embodiment, but will find other uses. Thus not all of the aspects of the present invention are necessarily limited to liquid crystal devices, nor to spatial light modulators. Nevertheless, it is useful to commence with a discussion of the problems encountered in developing the embodiment to be described later.

The liquid crystal phase has been recognised since the last celery, and there were a few early attempts to utilise liquid crystal materials in light modulators, none of which gave rise to any significant successful commercial use. However, towards the end of the 1960's and in the 1970's, to was a renewed interest in the use of liquid crystal materials in tight modulating, with increasing success as more materials, and purer materials became available, and as technology in general progressed.

Generally speaking this latter period commenced with the use of nematic and cholesteric liquid crystal materials. Cholesteric liquid crystal materials found use as sensors, principally for measuring temperature or indicating a temperature change, but also for responding to, for example, the presence of impurities. In such cases, the pitch of the cholesteric helix is sensitive to the parameter to be sensed and correspondingly alters the wavelength at which there is selective reflection of one hand of circularly polarised light by the helix.

Attempts were also made to use cholesteric materials in electro-optic modulators, but during this period the main thrust of research in this area involved nematic materials. Initial devices used such effects as the nematic dynamic scattering effect, and increasingly sophisticated devices employing such properties as surface induced alignment, the effect on polarised light, and the co-orientation of elongate dye molecules or other elongate molecules/particles, came into being.

Some such devices used cells in which the nematic phase adopted a twisted structure, either by suitably arranging surface alignments or by incorporating optically active materials in the liquid crystal phase. There is a sense in which such materials resemble cholesteric materials, which are often regarded as a special form of the nematic phase.

Initially, liquid crystal light modulators were in the form of a single cell comprising a layer of liquid crystal material sandwiched between opposed electrode bearing plates, at least one of the plates being transparent. Such cells were slow to operate and tended to have a short life due to degradation of the liquid crystal material. Quite early on it was recognised that the application of an average dc voltage to the liquid crystal cell was not beneficial, and at least in some cases produced degradation by electrolysis of the liquid crystal material itself, and schemes were evolved to render the average dc voltage to zero (dc balance).

It is now appreciated that other effects are also at work when a dc voltage is applied. When driving liquid crystal electro-optic devices for any length of time, a phenomenon known as image sticking may occur. Although the precise cause of this effect is unknown, there are theories that ions are trapped or a space charge is induced within the material in response to an overall dc field, and this results in a residual field even when the external dc field is removed. Whether to avoid electrolytic breakdown, or to avoid image sticking, it is evidently desirable that the time averaged voltage (that is, the average over the time that the voltage is actually being applied from an external source to the liquid crystal) applied to a liquid crystal material is zero.

The thickness of the liquid crystal layer in nematic cells is commonly around 20 to 100 microns, and there is a correspondingly small unit capacitance associated with a nematic liquid crystal cell. Furthermore, the switching time from a wholly "OFF" state to a wholly "ON" state tends to be rather long, commonly around a millisecond. Relaxation back to the "OFF" state can be somewhat longer, unless positively driven, but the "OFF" state is the only stable one.

At the same time, electro-optic nematic devices comprising a plurality of pixels were being devised. Initially, these had the form of a common electrode on one side of a cell and a plurality of individually addressable passive electrodes on the other side of the cell (e.g. as in a seven-segment display), or, for higher numbers of pixels, intersecting passive electrode arrays on either side of the cell, for example row and column electrodes which were scanned. While the latter arrangements provided considerable versatility, there were problems associated with cross-talk between pixels.

The situation was exacerbated when analogue (grey scale) displays were required by analogue modulation of the applied voltage, since the optical response is non-linearly related to applied voltage. Addressing schemes became relatively complicated, particularly if dc balance was also required. Such considerations, in association with the relative slowness of switching of nematic cells, have made is difficult to provide real-time video images having a reasonable resolution.

Subsequently, active back-plane devices were produced. These comprise a layer of liquid crystal material disposed between a back plane and a spaced opposed substrate. The backplane comprises a plurality of active elements, such as transistors, for energising corresponding pixels. Energisation normally involves cooperation with one or more counterelectrodes disposed on the opposed substrate, although it would be possible to provide counterelectrodes in the backplane itself for fields generally parallel to the plane of the liquid crystal layer.

Two common forms of backplane are thin film transistor on silica/glass backplanes, and semiconductor backplanes. The active elements can be arranged to exercise some form of memory function, in which case addressing of the active element can be accelerated compared to the time needed to address and switch the pixel, easing the problem of displaying at video frame rates.

Active backplanes are commonly provided in an arrangement very similar to a dynamic random access memory (DRAM) or a static random access memory (SRAM). At each one of a distributed array of addressable locations, a SRAM type active backplane comprises a memory cell including at least two coupled transistors arranged to have two stable states, so that the cell (and therefore the associated liquid crystal pixel) remains in the last switched state until a later addressing step alters its state. Each location electrically drives its associated liquid crystal pixel, and is bistable per se, i.e. without the pixel capacitance. Power to drive the pixel to maintain the existing switched state is obtained from busbars which also supply the array of SRAM locations. Addressing is again normally performed from peripheral logic and column and row address lines.

In a DRAM type active backplane a single active element (transistor) is provided at each location, and forms, together with the capacitance of the associated liquid crystal pixel, a charge storage cell. Thus in this case, and unlike a SRAM backplane, the liquid crystal pixels are an integral part of the DRAM of the backplane. There is no bistability associated with the location unless the liquid crystal pixel itself is bistable, and this is not normally the case so far as nematic pixels are concerned. Instead, reliance is placed on the active element providing a high impedance when it is not being addressed to prevent leakage of charge for the capacitance, and on periodic refreshing of the DRAM location.

In contrast to the type of RAM associated with computing, the pixel circuits, and more significantly the pixel trasistors, are often at least partially exposed to light This can lead to problems, especially with DRAM type backplanes where the pixels are part of the DRAM circuit, including photo-induced conductivity and charge leakage. This aspect is dealt with in greater detail in our copending International Patent application PCT/GB99/04279 (ref: P20960WO).

Thin film transistor (TFT) backplanes comprises an array of thin film resistors distributed on a substrate (commonly transparent) over what can be a considerable area with peripheral logic circuits for addressing the transistors, thereby facilitating the provision of large area pixellated devices which can be directly viewed. Nevertheless, there are problems associated with the yields of the backplanes during manufacture, and the length of the addressing conductors has a slowing effect on the scanning. When provided on a transparent substrate, such as of glass, TFT arrays can actually be located on the front or rear surface of a liquid crystal display device.

In view of their overall size, the area of the TFT array occupied by the transistors, associated conductors and other electrical elements, e.g. capacitors is relatively insignificant. There is therefore no significant disadvantage in employing the SRAM configuration as opposed to the DRAM configuration. This sort of backplane thus overcomes many of the problems associated with slow switching times of liquid crystal pixels.

Generally, the active elements in TFT backplanes are diffusion transistors and the like as opposed to FETS, so that the associated impedances are relatively low and associated charge leakage relatively high in the "OFF" state.

Semiconductor active backplanes are limited in size to the size of semiconductor substrate available, and are not suited for direct viewing with no intervening optics. Nevertheless their very smallness aids speed of addressing of the active elements. This type of backplane commonly comprises FETs, for example MOSFETs or CMOS circuitry, with associated relatively high impedances and relatively low associated charge leakage in the "OFF" state.

However, the smallness also means that the area of the overall light modulation (array) area occupied by the transistors, associated conductors and other electrical elements, e.g. capacitors can be relatively significant, particularly in the SRAM type which requires many more elements than the DRAM type. Being opaque to visible light, a semiconductor backplane would provide the rear substrate of a light modulator or display device.

At a later period still, substantial development occurred in the use of smectic liquid crystals. These have potential advantages over nematic phases insofar as their switching speed is markedly greater, and with appropriate surface stabilisation the ferroelectric smectic C phases should provide devices having two stable alignment states, i.e. a memory function.

The thickness of the layer of liquid crystal material in such devices is commonly much smaller than in the corresponding nematic devices, normally being of the order of a few microns at most. In addition to altering the potential switching speed, this increases the unit capacitance of a pixel, easing the function of a DRAM active backplane in retaining a switched state at a pixel until the next address occurs.

However, as the liquid crystal thickness approaches the thicknesses associated with the underlying structure of the backplane, and any possible deformation of the liquid crystal cell structure by flexing or other movement of the substrates, problems arise, for example as to the uniformity of response across the pixel area, and the capability for short circuiting across the cell thickness. These factors are dealt with in more detail in our copending International Patent application PCT/GB99/04282 (ref: P20959WO).

The possibility of long relaxation times, or even of bistability, of the liquid crystal cell or pixel, facilitates the introduction of a relatively new digital technique when a grey scale image is required, in which pixels are turned "ON" for a fraction of the viewing period according to the grey level. Essentially, the image is computationally decomposed to a series of bit planes in which each pixel is either "ON" or "OFF", the bit planes being sequentially displayed. In a preferred form, the (normally binary) weighted bit plane technique, the durations of the bit planes are weighted thereby reducing the number of bit planes required to synthesise an image, and reducing addressing requirements somewhat.

Pixel Structure—Switching and Address Times. When using a SRAM type backplane to switch a capacitive element the time necessary to address the location on the backplane can be as small as is necessary to switch that location, regardless of whether the capacitive element has responded. The location is always coupled to the power supply, and can continue to supply power (current/voltage) to the capacitive element after the addressing pulse has ceased.

By contrast power is supplied to a capacitive element from a DRAM location only while addressing is taking place, after which the active element (transistor) is turned off. If the addressing pulse is insufficiently long for transfer of the requisite amount of change, the capacitive element is incompletely switched. This is likely to occur, for example, when the capacitive element includes ferroelectic material, as in some smectic liquid crystal cells, and the addressing time is short, for example in a large scale army.

One solution is to provide an additional "slug" capacitance which is rapidly charged during the addressing pulse and so can provide a reservoir of charge while the capacitive element switches over a longer time period. This aspect is dealt with in more detail in our copending International Patent application PCT/GB99/04279 (ref: P20960WO), which relates to the provision of a semiconductor active backplane including an array of addressable active elements on a semiconductor substrate for energising respective first electrodes, wherein at least part of the region beneath a said electrode is adapted to act as a capacitor. In particular said part may be formed as a depletion region whereby in use it acts as a reverse biassed diode, or individual capacitor plates may be formed beneath the electrode, one coupled to the substrate and the other coupled to the electrode.

Smectic Liquid Crystal Electro-Optic Cells In the smectic liquid crystal phase, the molecules exhibit positional order ("layers") in addition to the orientational order exhibited by the cholesteric and nematic phases. There are a number of different smectic sub-phases which differ in the orientational order within the overall structure of the smectic layers, the most common being the smectic A phase (SmA) and the smectic C phase (SmC).

The common alignment for smectic materials is planar (molecules generally parallel to the major cell surfaces) with the smectic layers normal to the plane of the cell, as this permits the field to be applied across the cell thickness. It is possible to obtain homeotropic alignment with the smectic layers in the cell plane, and such a device could provide a fast refractive index modulator. However, in order to apply appropriate electric fields for switching, very small electrode gaps are required and therefore such devices tend to have very small active areas, and as a consequence this type of device is relatively uncommon.

In the smectic A phase the director is normal to the plane of the layers. application of an electric field perpendicular to the director causes the latter to tilt about an axis parallel to the applied field by an amount approximately linearly dependent of field strength, making it possible to achieve analogue grey scale modulation. Polarisation of the light is affected, so that intensity or phase modulation may be achieved, and since the rotation of the director is in the plane of the cell, normally incident light is always perpendicular to the optic axis of the material. Coupled with the thinness of the cell, this leads to improved viewing angles for such devices. This effect, called the electroclinic effect, is extremely fast, switching times down to around 100 nanoseconds having been observed.

In the smectic C phase, the director forms a constant ("tilt") angle with the plane of the smectic layers. The tilt angle depends on the material and the temperature, and defines a cone with its tip on the smectic layer and its axis normal to the layer, all possible positions of the director lying on the cone surface. In the bulk of a chiral smectic C phase (SmC*) the director precesses from layer to layer as in a helix.

In the chiral smectic C phase, liquid crystal materials are ferro-electric, having a permanent dipole, sometimes termed spontaneous polarisation ($P_s$) In the bulk material, $P_s$ rotates in the plane of the layer as the director precesses, so no net effect is observable. Bulk ferro-electricity can be observed if the precession is suppressed, either by surface stabilisation of the director positions such that only the two orientations of director which lie in the plane of the device are possible, and/or by back-doping with a chiral material of the opposite hand.

Smectic C* materials can be broadly divided into two classes known as high and low tilt materials respectively. Class I materials have the phase sequence isotropic—nematic—smectic A*—smectic C*, and tend be low tilt materials, having tilt angles generally grouped up to around 22.5° (cone angle of 45°); class II materials have the phase sequence isotropic—nematic—smectic C*, and tend to be high tilt materials with greater tilt angles. Materials with a cone angle greater than 75° are rare, although for holographic applications, which require phase modulation, a cone angle of 90° would be ideal.

With low tilt materials, the smectic layers are inclined relative to the cell surface rather than at right angles, such that the director cone has a tilted axis and its surface is tangential to the cell surface. For high tilt materials the cone axis is normal to the cell surface.

When the structure is surface stabilised, then in theory, at least for Class I materials there is no preference between the two states of a low tilt material and a bistable structure should result. Surface stabilisation can be achieved simply by making the layer in the cell thin. The two states will have different effects on polarised light, and so can provide intensity or phase modulation. In practice, it is very difficult or impossible to obtain true bistability, especially on silicon backplanes and there will a slight preference for one state over the other. Nevertheless, this should give rise to relatively long relaxation times.

For high tilt materials, the two states are not equal, and one state is preferred over the other, so that there is monostability in the absence of any other factor. The two states are such that phase modulation of light may be obtained, and, indirectly, intensity modulation, e.g. in holographic applications. Both high and low tilt materials may be used in the spatial light modulator of the invention.

Stability/Relaxation The presence of the spontaneous polarisation, and its realignment as the liquid crystal molecules realign under the influence of an electric field, leads to a significant additional current or charge flow during realignment, e.g. between electrodes either side of a smectic layer. A pixel of area A will consume a charge of $2AP_s$ during switching. This factor is particularly important when pixel switching is controlled by a DRAM type of active backplane, when pixel capacitance and $P_s$ become important design parameters. It should also be noted that charge consumption reduces the field across the electrodes in such devices if the addressing pulse is insufficiently long to accommodate pixel switching, as in the present preferred embodiment.

As has already been noted, the use of the backplanes described herein is not limited to liquid crystal devices. However, these backplanes are particularly suited for use in the manufacture of liquid crystal devices. Again, although it is possible to employ nematic or cholesteric materials in such devices, it is preferred to employ smectic materials because of their faster switching action.

Other reasons for preferring smectic materials are the fast switching times; and, in the case of using a DRAM type active backplane (this does not apply when the backplane is the SRAM type since power/current can be continuously applied to each pixel), the ability to extend the relaxation time, or even to obtain a bistable effect, once the pixel has been placed in the desired state. One advantage of having a fast switching time in the case where relaxation occurs lies in the increase of the fraction of the pixel repeat address period usable for viewing time. Another advantage, particularly where optical processing is concerned is the increase in data throughput.

Electrostatic Stabilisation The charge consumption which occurs when a pixel is switched in one direction gives rise to a corresponding generation of charge when the pixel switches in the other direction. Therefore, if a switched pixel is completely electrically isolated, charge cannot flow and the pixel cannot relax. In operation of a DRAM type array, this may be effected by turning off all the transistors of the array, and in the preferred embodiment this is made possible by applying a global reset signal NRAR to the row scanners. Also, in some embodiments of addressing scheme, all the transistors are left in the off state once all the rows in the frame have been scanned, until the start of the next frame scan. (Other embodiments of addressing scheme, including those with ac stabilisation, do require transistors to be left on).

In practice, charge leakage cannot be completely eliminated, and so relaxation will occur, but over an extended period. A common cause of charge leakage is photoconductivity associated with the slug capacitance mentioned earlier and/or photoconductive or other leakage currents in the associated switching transistor of the DRAM array.

Electrical isolation is thus a useful but imperfect tool for prolonging relaxation times. It will be appreciated that whether a long relaxation time is achieved through an appropriate choice of material and cell design, or by electrical isolation, the important factor is that sufficient time can be allowed between successive addressings of any pixel for it to be maintained essentially in its desired state.

AC Stabilisation During relaxation, the director rotates out of the plane of the device to the alternative position If an electric field is applied to a material, the field itself induces a polarisation of the material, and the polarisation reacts to the field, resulting in a torque that is proportional to the square of the field and so independent of field polarity. With a material having negative dielectric anisotropy this torque acts to maintain the molecule in the plane of the pixel, thereby "locking" the liquid crystal director orientation in either of its switched states. Thus the continuous application of an alternating electrical field between successive addressings (normally of low amplitude relative to the switching voltage) prevents relaxation of the director to the alternative orientation. Any tendency for the director to rotate from either of the two preferred orientations is effectively immediately counteracted by the ac field which returns the director to the orientation that it should have. The effect should obtain for as long as the ac field is present, so that the device behaves as if it were bistable.

In a DRAM array device this effect can be obtained by globally turning on all of the DRAM switching transistors, applying the same dc signal (e.g. zero or V volts) to all of the column electrodes, and by applying an ac voltage to the common front electrode with dc level corresponding to that applied to the column electrodes.

This endless prolongation of the switched pixel states is particularly important in certain types of optical processing where the same optical state may need to be maintained for days, months or even years.

SUMMARY

It is therefore clear that during operation of the array it would be desirable to be able simultaneously to enable a plurality of the rows, and more preferably all the rows, so that all of the enabled pixels down each column may be brought simultaneously to the same state. This has already been mentioned in connection with the provision of blanking and ac stabilisation for prolonging the switched state of a pixel, and it is also desirable insofar as it permits the length of time that a dc pulse of potential is applied to be clearly and precisely defined, which is desirable when considering dc balancing. Following such enabling, and where ac stabilisation is not used, it is also desirable to disable the enabled transistors, preferably a global disable over the entire array, to prevent relaxation due to short circuiting of a liquid crystal cell, for example.

In the embodiment to be described hereafter, where the parallel data fed to the columns is identical, and all of the rows are enabled, the whole array can be brought to zero or one, thereby blanking the array. If the parallel data along the columns is varied, a vertically striped image is produced.

If the potential difference between the front electrode and the columns during blanking is zero, the pixels will be short circuited, thereby permitting relaxation to take place. Alternatively, the potential difference may be a positive or negative dc, thus driving all of the pixels relatively rapidly on or off. If the dc potential difference is zero but a small ac voltage is present, preferably on the common front electrode for ease of application, in certain circumstances the pixels can be maintained in their existing states, as described in more detail elsewhere m this specification (ac stabilisation).

Accordingly, the invention provides al active backplane arrangement comprising an array of electrically addressable elements defined on an active backplane, said array comprising a first plurality of mutually exclusive sets of said elements, the arrangement also comprising set scanning means arranged to address all said sets of the first plurality one set at a time in a predetermined order, characterised in that the arrangement further comprises set selecting means for selectively addressing each sad set independently of said set scanning means whereby more than one, or all, of said first plurality of sets may be addressed simultaneously.

Many arrays are addressed via orthogonal sets of conductors, and while the most common form of array is arranged as addressable rows (the sets) and columns, other arrangements are possible, for example based on polar co-ordinates (distance and angle). However, modern computing methods and standards converters have tended to make other formats redundant in the majority of cases.

Preferably, the set scanning means includes at least one shift register having a plurality of stages, each said set being coupled to the output of a respective stage. Thus a token inserted at the start of a register may be clocked down the register to address each set in turn. Preferably, the outputs from the register or subsequent circuitry, is arranged to respond to a (clock) pulse to remove the address before a further set of elements is addressed.

A first control input may be provided on each output stage of the shift register(s) which when activated passes a first predetermined signal to its set (this encompasses circuitry between an output stages and its sets, so that the control input either latches the output stage or dominates it). This can be used to switch all the elements of selected sets into the same first predetermined state, and in use in the preferred embodiment it serves to turn on all the switching transistors of a DRAM type array.

Output stages of the shift register, or circuitry between the output stages and the ("selected") sets, may further include second control inputs which when activated pass a second predetermined signal to all of the "selected sets". This second predetermined signal differ form the first, and can be used to switch all the elements of the selected sets into the same second predetermined state, different from the first. In use in the preferred embodiment, it serves to turn off all the switching transistors of a DRAM type array.

Preferably, it is arranged that one of the first and second predetermined signals takes precedence over the other.

When the elements are arranged as rows (sets) and columns, there may be two shift registers, one for the odd rows and one for the even rows. It may be arranged so the output from only one shift register is active at any time, so that only one row is addressed, following removal of the address to the previous row.

The shift registers may be locked, with means arranged for clocking only one register at a time. This clocking action may be varied to provide sequential (progressive) or interlaced scans as required, e.g. by clocking one full register and then the other, or by clocking each register alternately, to address a row at a time. However, it is also possible to have the outputs from both registers active simultaneously, e.g. for an adjacent pair of an odd and an even row.

To increase the number of sets of elements addressed by the shift register(s), the outputs thereof may be followed by a demultiplexer. This also increases the order in which the rows may be addressed.

Where the elements of the array have a second addressable input, the second addressable inputs of a plurality (and preferably all) of said columns may be addressed simultaneously.

The second addressable inputs may be arranged to receive data from a lesser plurality n of parallel data lines via demultiplexers. The demultiplexers may include selectively operable pluralities n of latches for receiving data from the input lines in parallel. In this case, the selective operation of the latches may be over-ridden, so that data is latched and supplied to all the columns simultaneously. This may be of use when the array is blanked, etc.

European Patent Application No. 97304638.6 relates to a spatial light modulator or display having rows and columns of pixels wherein both the rows and columns are scanned by reconfigurable shift registers. Logic associated with the registers proper is arranged so that the thickness of a token passed therealong, i.e. the number of rows or columns simultaneously addressed, may be locally varied whereby the local resolution of the display may be altered. In such an arrangement, the rows or columns which are simultaneously addressed are necessarily adjacent, and there is no possibility of selectively addressing any row or column other than by the normal scanning operation of the registers.

European Patent application No. 88202941.6 relates to a matrix display device in which pairs of successive rows may be written to contain the same image information so that a break in a conductor in one row can be remedied by bringing forward information from the preceding row. Again, simultaneous addressing is limited to adjacent rows and rows cannot be selected independently of the scanning action.

BRIEF DESCRIPTION OF THE CLAIMS

Further features and advantages of the invention can be derived from a consideration of the appended claims, to which the reader is referred, and of the follow description of an embodiment of the invention made with reference to the accompanying drawings, in which:

Figure 4:
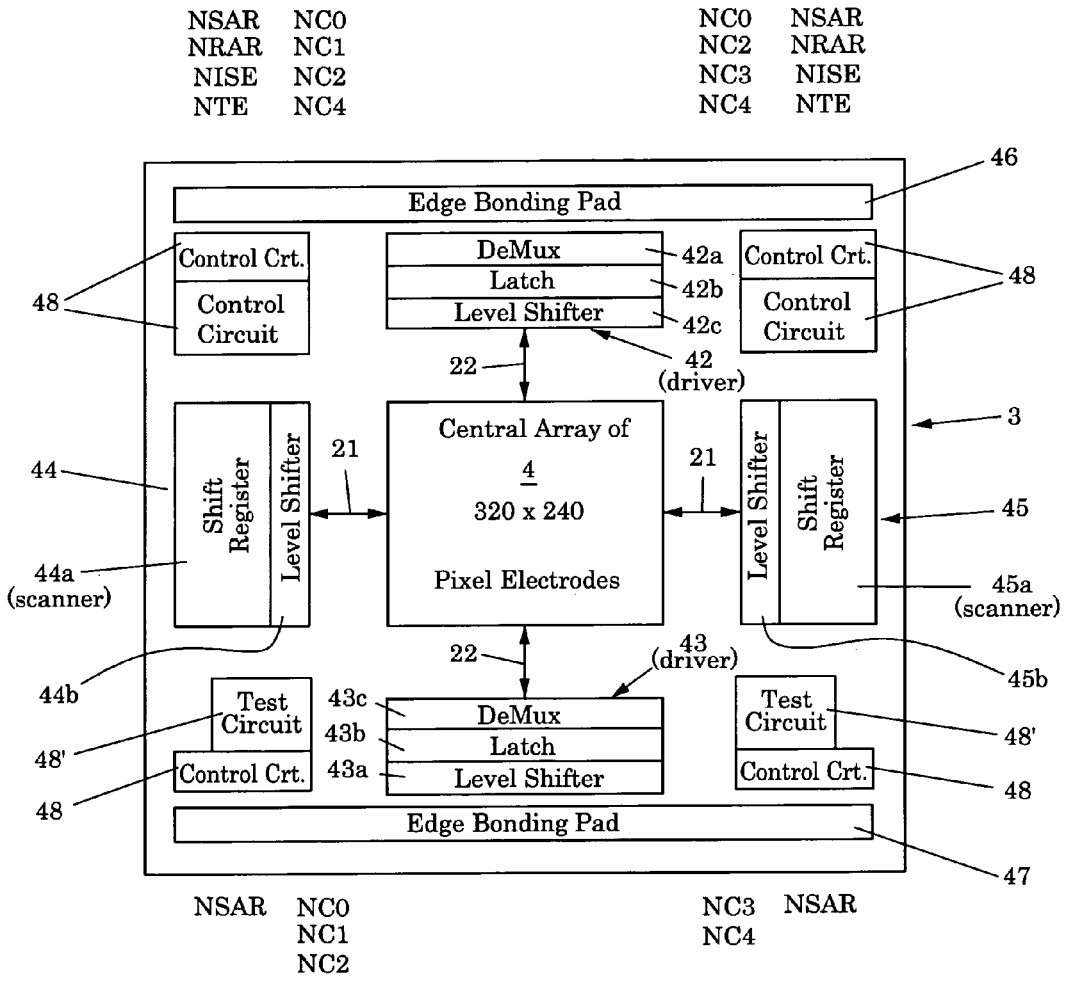
FIG. 4 is a schematic plan view (floorplan) of the active backplane of the liquid crystal cell of FIG. 1, including a central pixel array.
Figure 7:
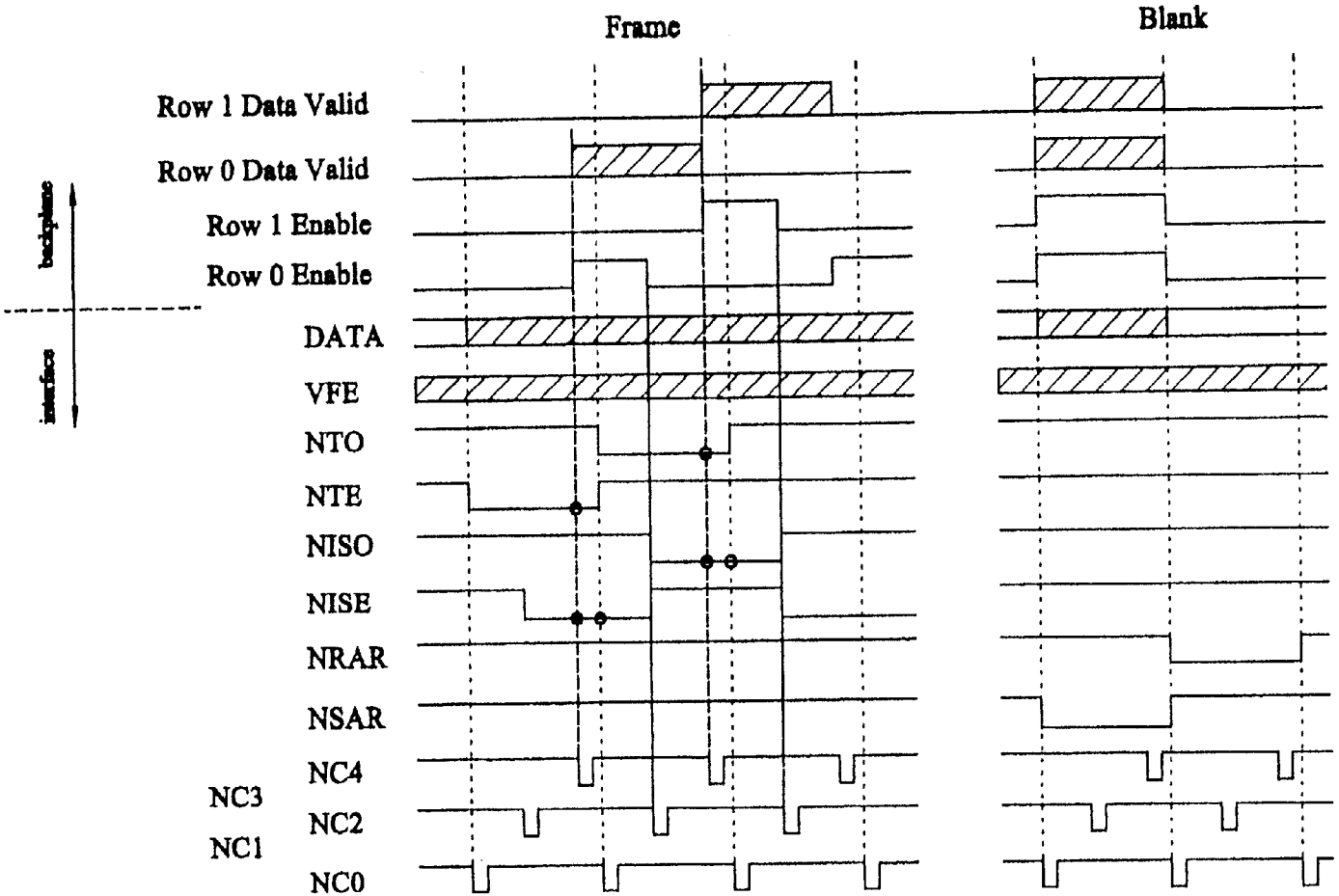
Figure 7A:
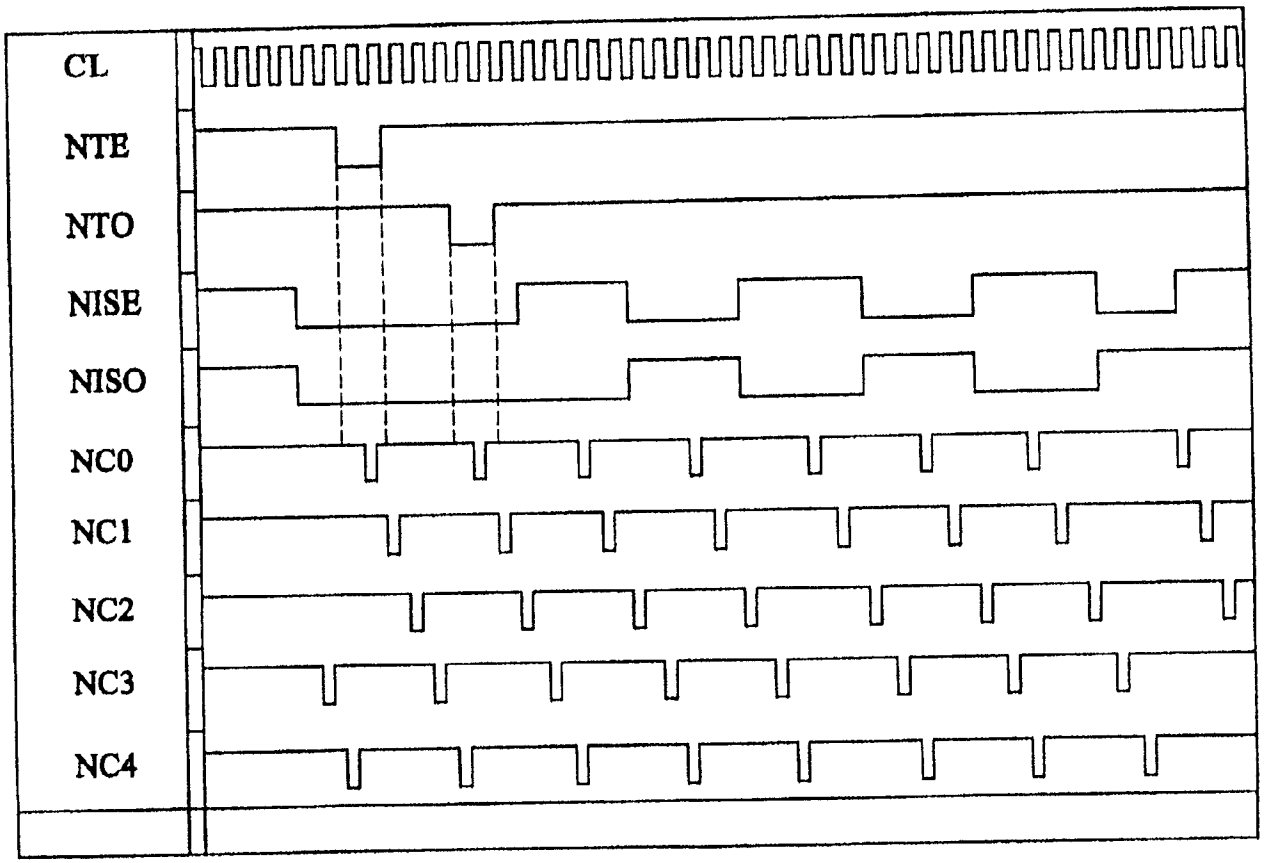
Figure 8:
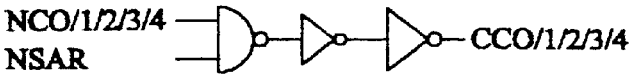
Figure 8:
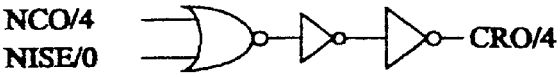
Figure 8:
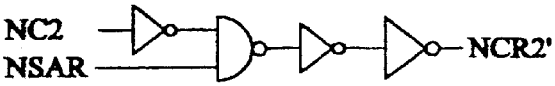
Figure 8:
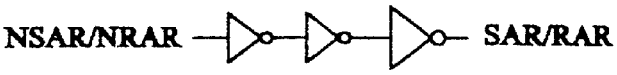

FIGS. 7 and 7*a* are waveform diagrams;

FIG. 8 is a schematic circuit diagram showing part of the control circuits of FIG. 4

Figure 9:
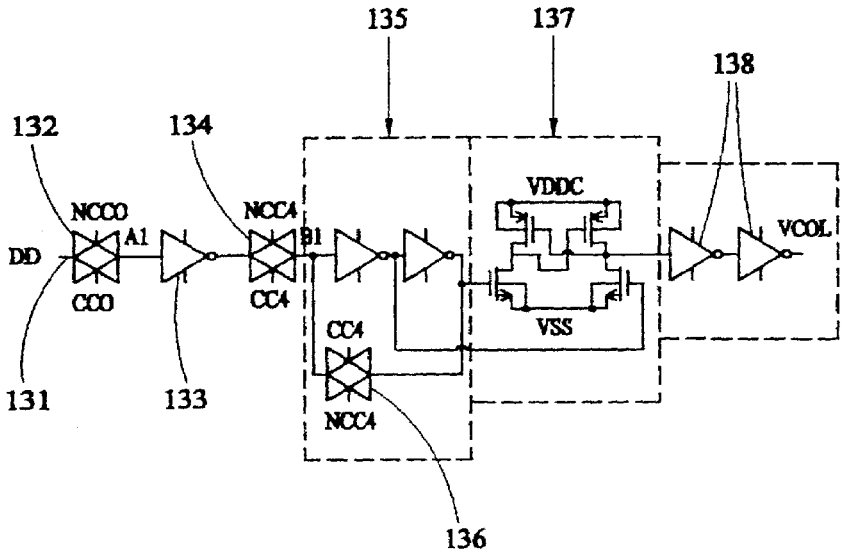
Figure 10:
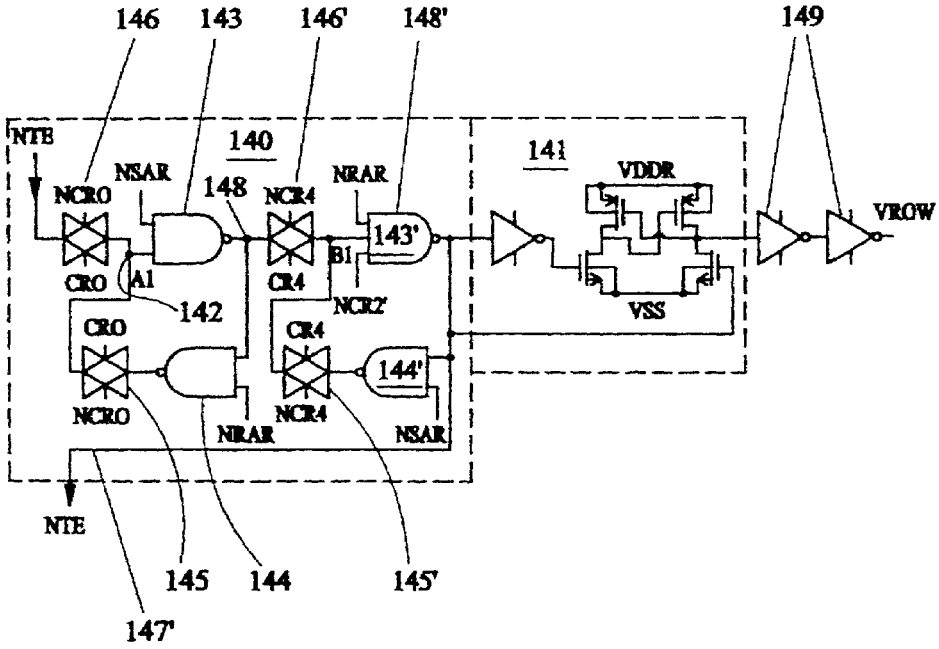
Figure 11:
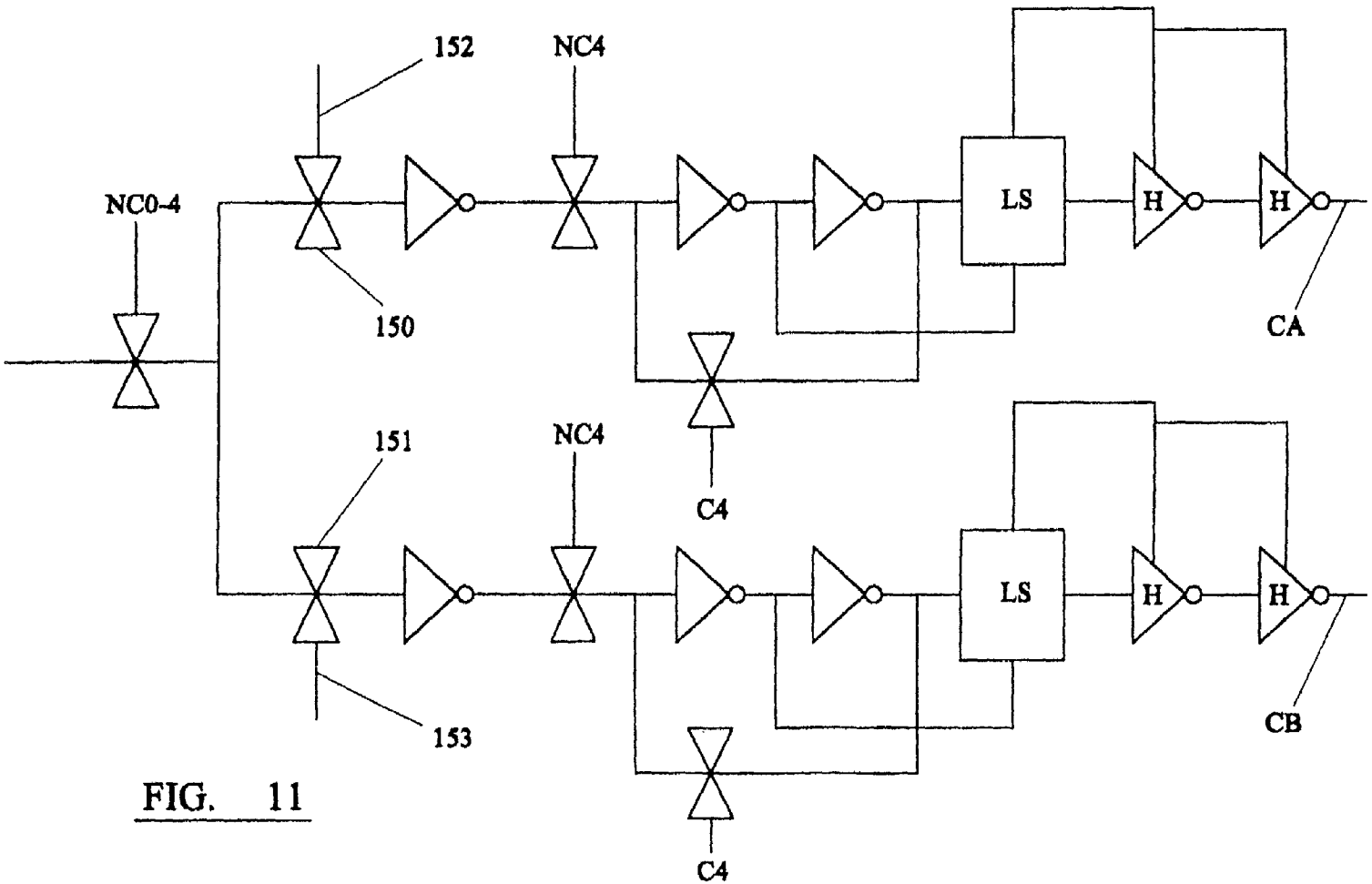
Figure 13B:
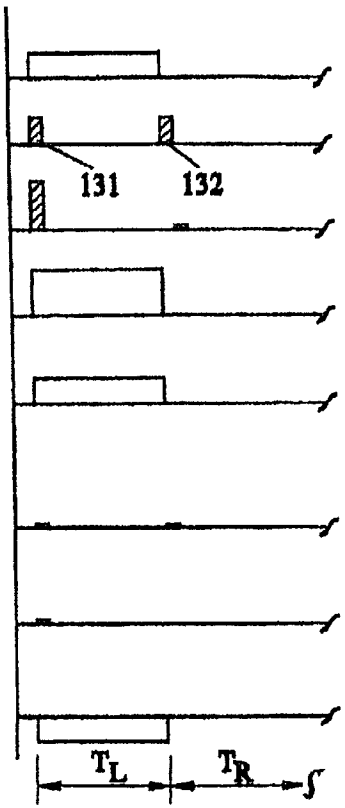
Figure 13A:
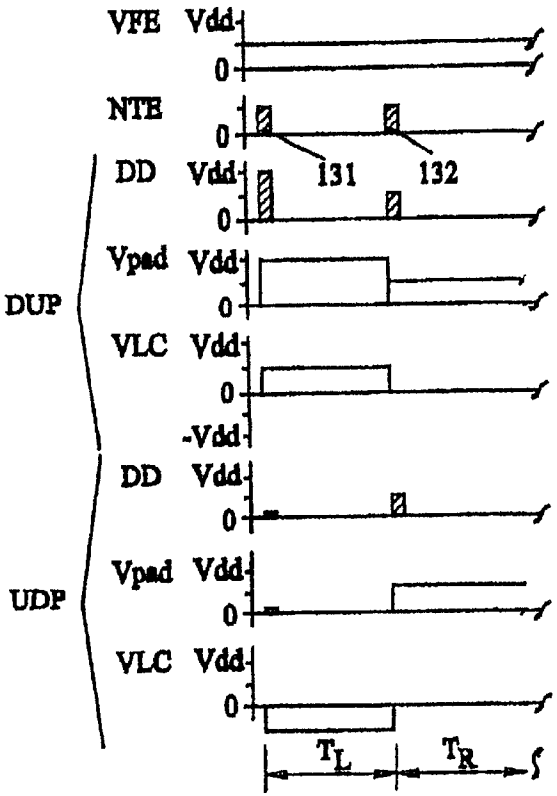
Figure 13:
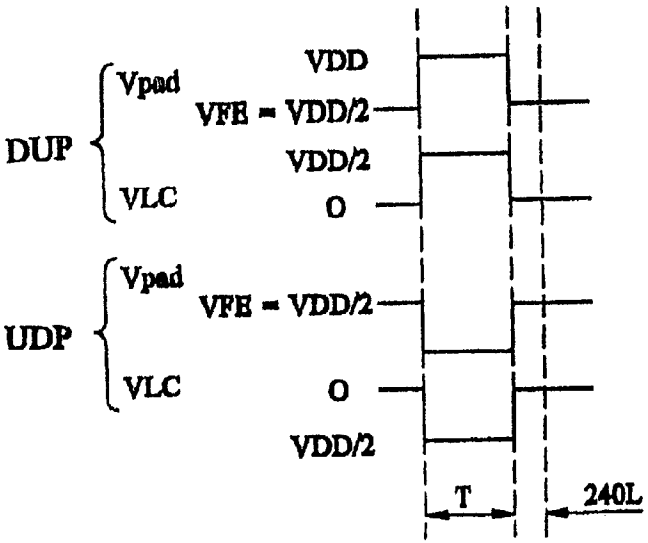
Figure 14:
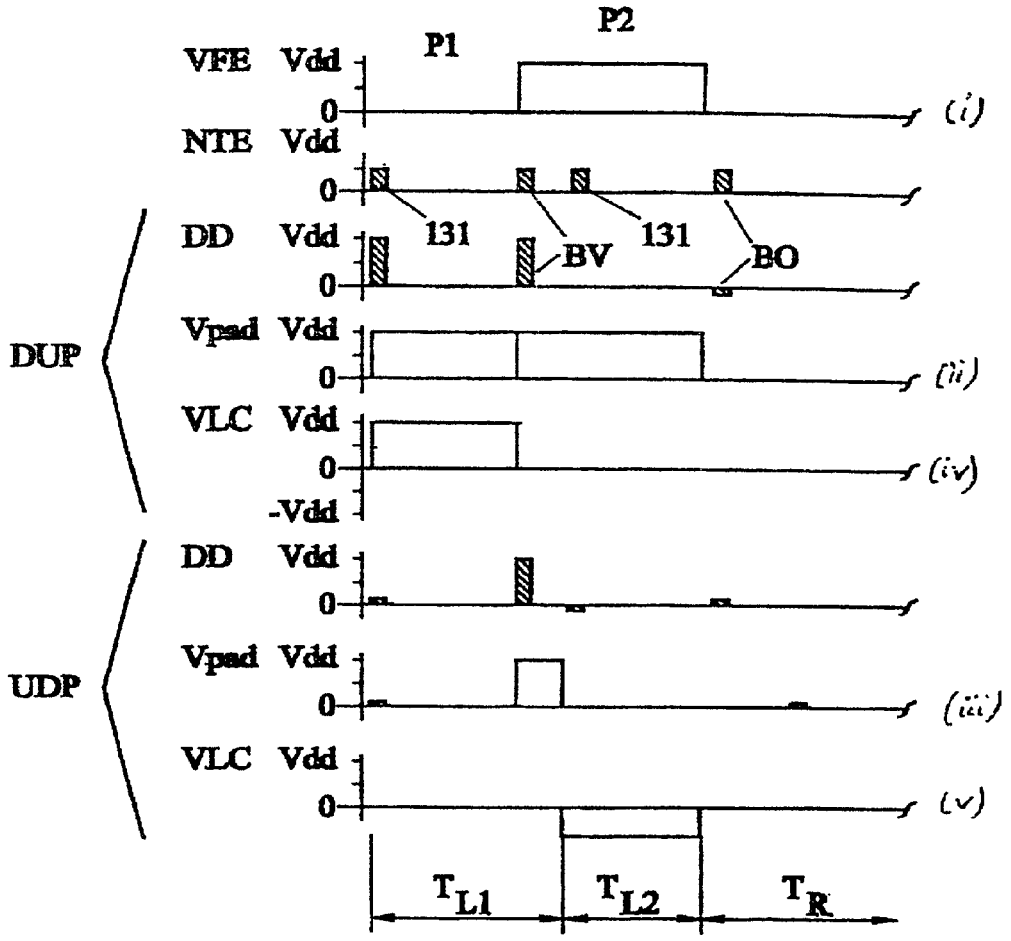
Figure 15:
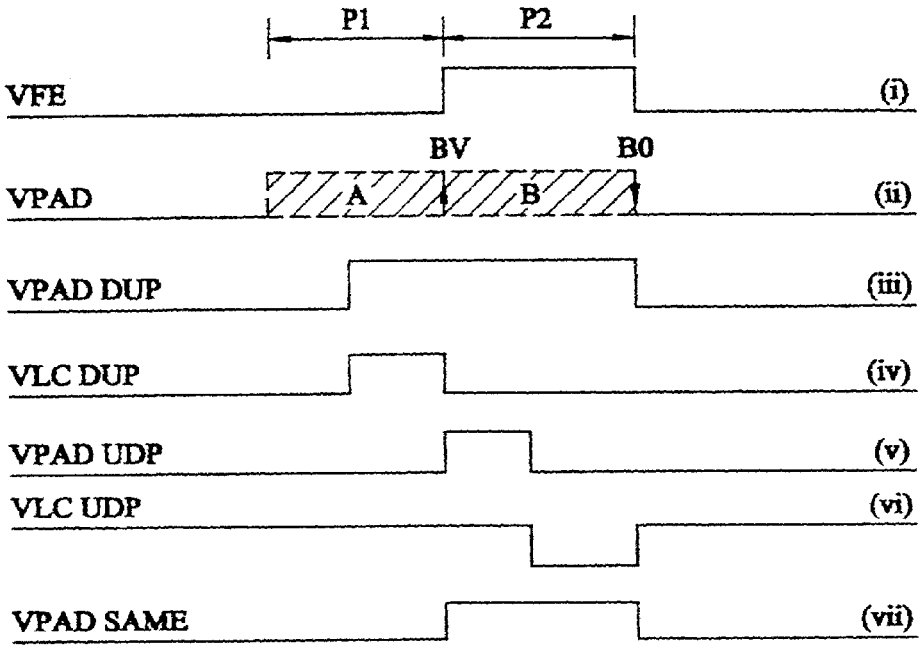
Figure 16:
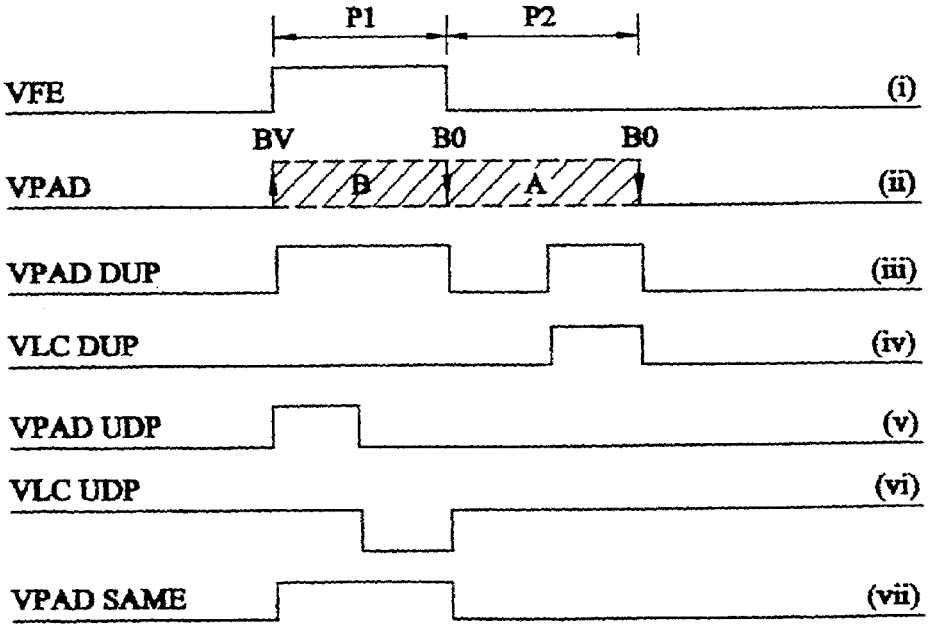
Figure 17:
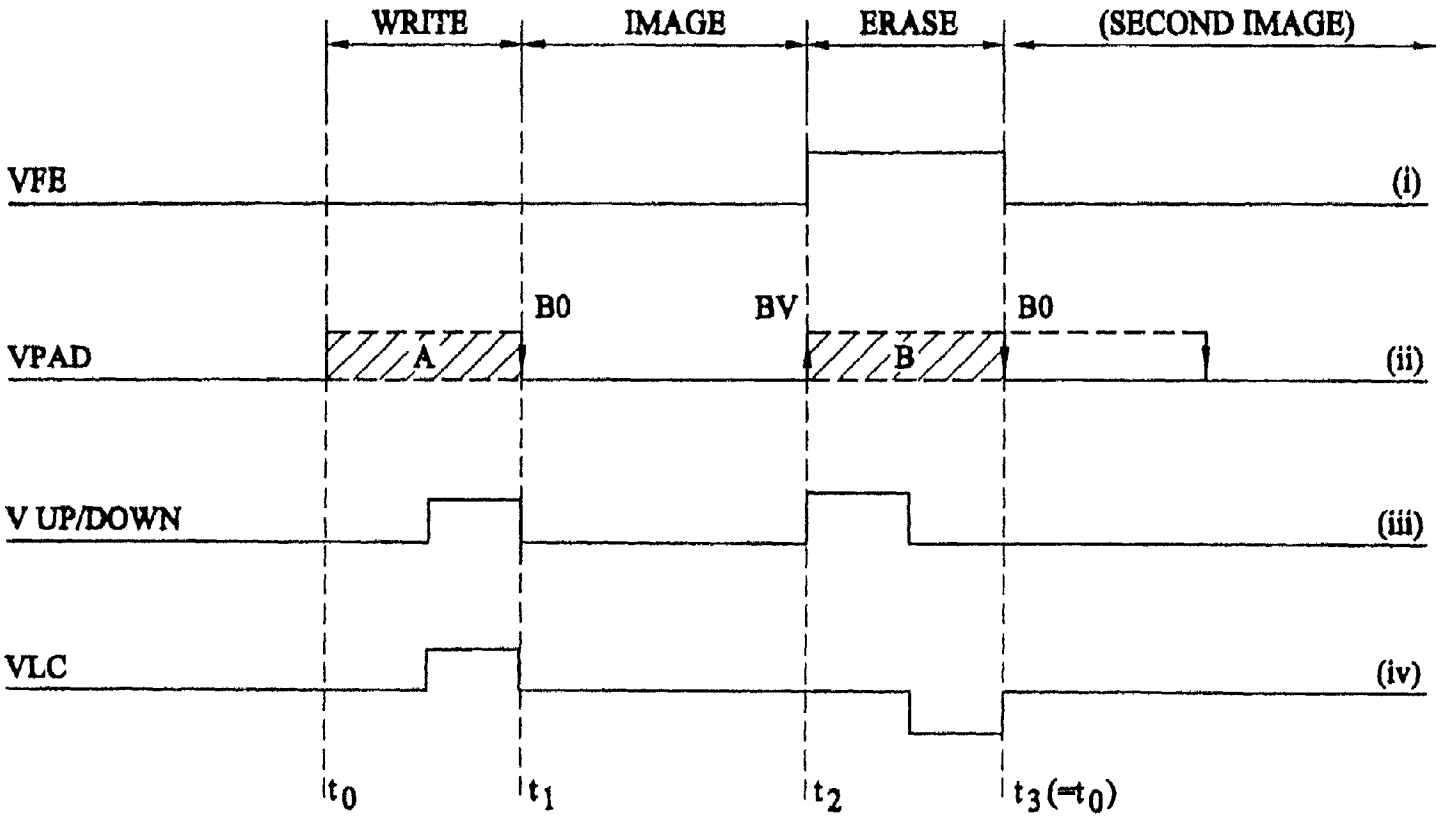

FIG. 9 is a schematic circuit diagram showing part of the column drivers of FIG. 4;

FIG. 10 is a schematic diagram showing part of the row scanners of FIG. 4;

FIG. 11 shows a modification of the circuit of FIG. 9 for increasing the number of columns addressed;

FIG. 12 shows modifications of FIG. 10 for increasing the number of rows addressed;

FIG. 13 shows waveforms used to illustrate a one-pass image writing scheme; and FIGS. 14 to 16 show waveforms used to illustrate two-pass image writing schemes; and FIG. 17 shows waveforms for illustrating a modification of the scheme of FIG. 14.

DETAILED DESCRIPTION

Figure 1:
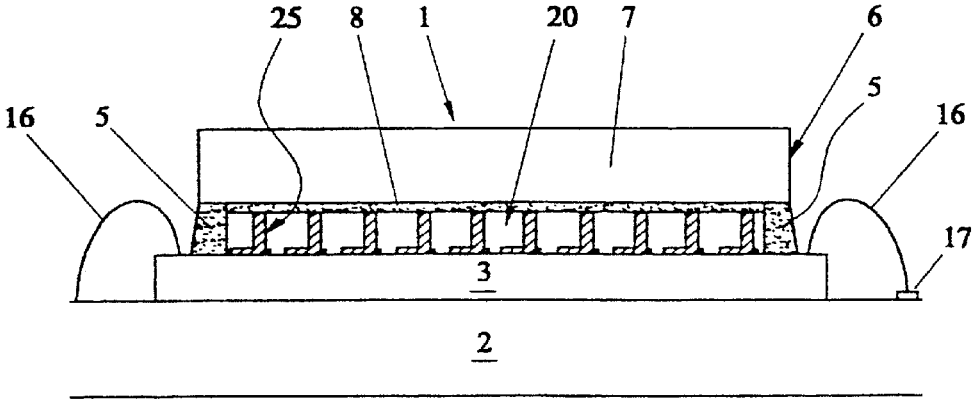
FIG. 1 shows in schematic cross-sectional view a liquid crystal cell which incorporates an active backplane and is mounted on a substrate.

FIG. 1 shows in schematic cross-sectional view a liquid crystal cell 1 mounted on a thick film alumina hybrid substrate or chip carrier 2 with wires 16 extending from the cell to pads 17 on the carrier. The cell 1 is shown in exploded view in FIG. 2. The use of a hybrid substrate for mounting electro-optic devices is discussed in more detail in our copending International Patent application PCT/GB99/04285 (ref: P20960WO)

Figure 2:
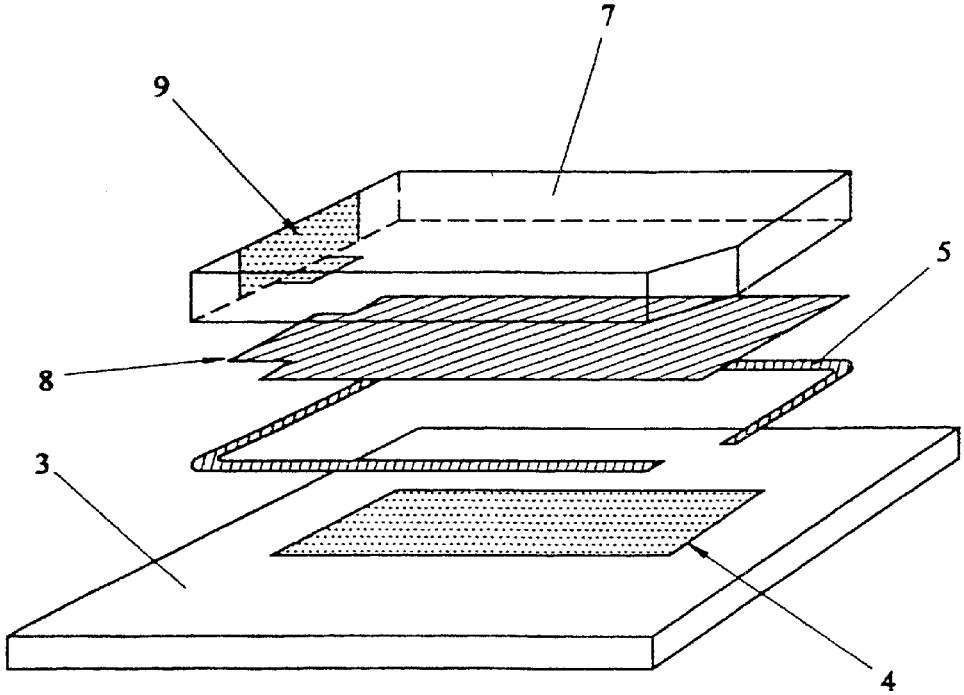
FIG. 2 is an exploded view of components of the liquid crystal cell of FIG. 1.

Cell 1 comprises an active silicon backplane 3 in which a central region is formed to provide an array 4 of active mirror pixel elements arranged in 320 columns and 240 rows. Outside the array, but spaced from the edges of the backplane 3, is a peripheral glue seal 5, which seals the backplane 3 to the peripheral region of a front electrode 6. FIG. 2 shows that the glue seal is broken to permit insertion of the liquid crystal material into the assembled cell, after which the seal is completed, either by more of the same glue, or by any other suitable material or means known per se.

Front electrode 6 comprises a generally rectangular planar glass or silica substrate 7 coated on its underside, facing the backplane 3, with a continuous electrically conducting silk screened indium-tin oxide layer 8. On one edge side of the substrate 7 is provided an evaporated aluminium edge contact 9, which extends round the edge of the substrate and over a portion of the layer 8, thereby providing an electrical connection to the layer 8 in the assembled cell 1.

Insulating spacers 25 formed on the silicon substrate of the backplane 3 extend upwards to locate the front electrode 6 a predetermined, precise and stable distance from the silicon substrate, and liquid crystal material fills the space so defined. As described later, the spacers 25 and the backplane 3 are formed on the silicon substrate simultaneously with formation of the elements of the active backplane thereon, using all or at least some of the same steps.

Figure 3:
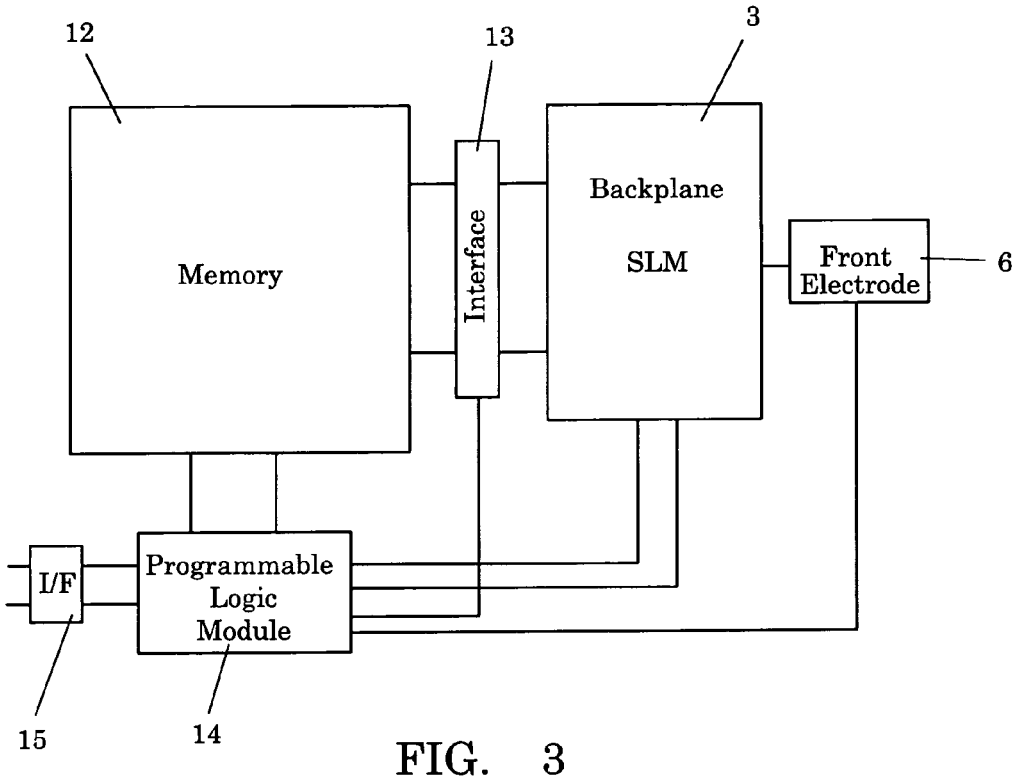
FIG. 3 is a schematic block circuit diagram showing circuitry closely associated with the liquid crystal cell of FIG. 1.

FIG. 3 is a schematic outline of circuitry on the PCB 11 closely associated with operation of the cell 1, here shown schematically as backplane 3 and front electrode 6. Backplane 3 receives data from a memory 12 via an interface 13, and all of the backplane 3, front electrode 6, memory 12 and interface 13 are under the control of a programmable logic module 14 which is itself coupled to the parallel port of a PC via an interface 15.

FIG. 4 shows a general schematic view of the layout ("floorplan") of the active backplane 3. As will be described in detail later with reference to FIGS. 5 and 6, each one of the central array 4 of pixel active elements is composed essentially of an NMOS transistor having a gate connected to one of a set of a row conductors, a drain electrode connected to one of a set of column conductors and a source electrode or region which either is in the form of a mirror electrode or is connected to a mirror electrode. Together with an opposed portion of the common front electrode 6 and interposed chiral smectic liquid crystal material 20, the rear located mirror electrode forms a liquid crystal pixel cell which has capacitive characteristics.

Even and odd row conductors are connected to respective scanners 44, 45 spaced either side of the array. Each scanner comprises a level shifter 44*b*, 45*b* interposed between a shift register 44*a*, 45*a* and the array. In use, a token signal is passed along the registers to enable (render the associated transistors conductive) individual rows in turn, and by suitable control of the registers different types of scan, e.g. interlaced or non-interlaced, can be performed as desired.

Even and odd column conductors are connected to respective drivers 42, 43 spaced from the top and bottom of the array. Each driver comprises a 32 to 160 demultiplexer 42*a*, 43*a* feeding latches 42*b*, 43*b*, and a level shifter 42*c*, 43*c* between the latches and the column conductors. In use, under the control of a 5-phase clock, data from the memory 24 for successive sets of 32 odd or even column conductors is passed from sets of edge bonding pads 46, 47 to the demultiplexers 42*a*, 43*a*, and latched at 42*b*, 43*b* before being level shifted at 42*c*, 43*c* for supply as a driving voltage to the column conductors. Synchronisation between the row scanning and column driving ensures that the appropriate data driving voltage is applied via the enabled transistors of a row to the liquid crystal pixels, and for this purpose various control circuits 48 and test circuits 48' are provided.

Subsequent disabling of that row places the transistors in a high impedance state so that charges corresponding to the data are then maintained on the capacitive liquid crystal pixels for an extended period, until the row is again addressed, for example either for writing another image (or rewriting the same image) or for stabilising the existing image.

Figure 5:
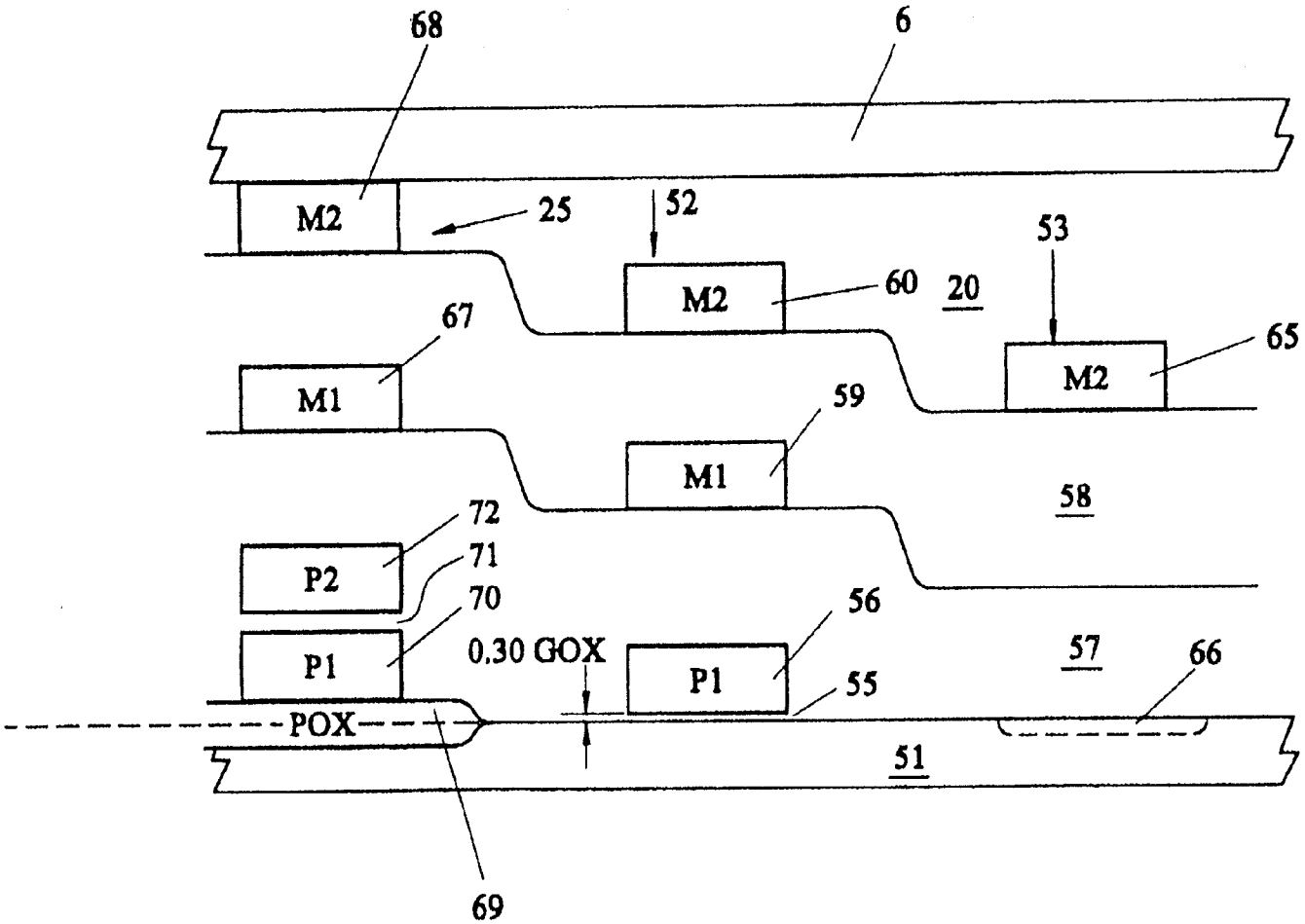
FIG. 5 is a schematic cross sectional view of part of the backplane of FIG. 4 to illustrate the various layers and heights encountered in the region of the pixel array.

As schematically illustrated in FIG. 5, the active backplane is based on a p-type silicon substrate 51. In the region of the array 4 it includes NMOS transistors 52, pixel mirrors 53 and the insulating spacer columns 25, and the substrate 51 is covered first by a lower substantially continuous silicon oxide layer 57 and then by an upper substantially continuous silicon oxide layer 58. Insulating ridges constructed similarly to the spacers and of similar height are formed outside the region of the array 41. The function of the insulating pillars and ridges is to ensure a constant and accurate spacing between the front electrode 22 and the silicon substrate 51, to prevent short circuits between the backplane and the front electrode and to provide electrical and optical uniformity and behaviour in the liquid crystal pixel array.

Figure 6:
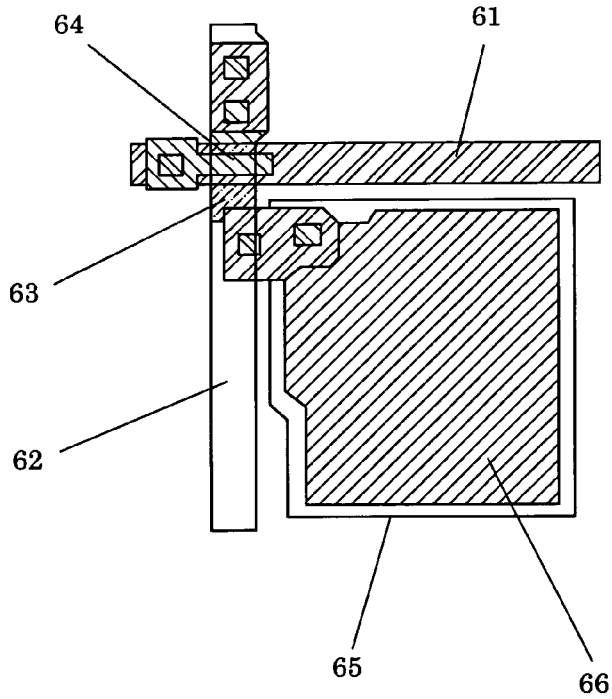
FIG. 6 is a schematic plan view of a single pixel of the array of the backplane of FIG. 4.

It should be noted that FIG. 5 is included merely to illustrate the different heights encountered in the backplane and that the other spatial arrangements of the elements do not correspond to what is found in practice. FIG. 6 shows a plan view of an actual arrangement of transistor and mirror electrode, generally similar to that of FIG. 5, but with the column 25 not shown. Transistors 52 are the highest part of the circuitry itself.

In addition to these layers, the transistor 52 is further defined by a metallic gate electrode 59 on the layer 57 and a metallic drain electrode 60 on layer 58. Electrodes 59 and 60 are connected to a row conductor 61 and a column conductor 62 respectively. At the transistor 52, the layer 57 is modified to include a polysilicon region 56 spaced from the substrate 51 by a very thin gate oxide layer 55.

The transistor source is in the form of a large diffusion region 63 within the layer 58 which is connected to electrode 65 of the pixel mirror 53, with the gate region 64 being located essentially under the crossover region of the column and row conductors 61, 62 to maximise the fill factor and to protect it from incident light.

The pixel mirror is formed by the pixel electrode 65 on layer 58, which electrode is of the same metal as, and formed simultaneously with, the drain electrode 60. Beneath most of the mirror electrode 65 there is formed a depletion region 66 in the substrate 51. In the assembled device, the pixel electrodes are spaced from the opposed front electrode by somewhat less that 2 microns with smectic liquid crystal material 20 interposed.

The pixel mirror is essentially flat, since there are no underlying discrete circuit elements, and occupies a proportion (fill factor) of around 65% of the pixel area. The need to maximise the fill factor is one consideration in the decision to employ a DRAM type backplane, rather than the SRAM type in which more space needs to be devoted to the two transistors and their associated elements.

An insulating column or pillar 54 which is associated with each pixel extends above the topology of the rest of the backplane 21, but is also composed of the layers 57, 58 over the substrate 51, with a first metal film 67 between the layers 57, 58 and a second metal film 68 between layer 58 and (in use) the front electrode 22. First and second metal films 67, 68 are of the same metals, and deposited at the same time, as the electrodes 59, 60 of the transistor 52. In the region of the spacer, the substrate is modified to provide a field oxide layer 69, and the bottom of layer 57 is modified to provide two polysilicon layers 70, 72 spaced by a thin oxide layer 71.

Although it includes metallic layers, the spacer provides good insulation between the front electrode and the active backplane. By forming insulating spacers in this manner, it is possible to locate them accurately relative to other elements on the backplane, thereby avoiding any interference with optical or electrical properties, and by creating them at the same time as the active and other elements of the backplane, using the same processes, there are advantages in terms of cost and efficiency.

As mentioned above, a pixel cell thus formed has capacitance. Chiral smectic liquid crystal materials are ferroelectric, so that application of an electric field sufficient to cause realignment of the molecules is associated with an additional transfer of charge. This effect is associated with a time constant insofar as the liquid crystal material takes time to realign.

The requirement for charge to flow during realignment, and the associated time constant, have a number of consequences. In particular, while the realignment can be relatively fast, it may still be much less than is required for fast scanning of the device.

With a SRAM type backplane, the state of a pixel is retained until the next address, and with power being supplied from a bus current can be supplied until realignment has been completed. However, with a DRAM type backplane, power is supplied to each pixel only during the addressing period. The capacitance of the cell is relatively small, and cannot retain sufficient charge for realignment to be completed.

One way of dealing with this problem is to provide each pixel with an additional "slug" capacitance which is quickly charged when the pixel is addressed, its charge thereafter being consumed as the liquid crystal molecules realign and subsequent pixels are being addressed. Thus the slug capacitance effectively avoids the need for an addressing pulse as long as the realignment time.

In FIG. 5, the diffusion layer 66 forms in use a reverse biassed diode, the depletion region of which acts as the slug capacitance.

The smectic liquid crystal used in the embodiment has a monostable alignment, so that for the DRAM type pixel element to remain in the switched state until it is next addressed, it is essential to limit charge leakage. In a sense, the fact that there is an additional charge displacement during realignment is helpful, in that the amount of charge leakage to permit relaxation to the original state is relatively large.

Unlike a conventional encapsulated computer DRAM, illuminating light can penetrate to the backplane. If it reaches sensitive elements, photoconductivity can permit relaxation of the pixel in less time than the scanning period, and this should not be allowed to happen. Steps therefore need to be taken (a) to reduce light penetration to sensitive elements as far as possible; and (b) to alleviate the effects of any light which nevertheless still penetrates.

In FIGS. 5 and 6, step (a) is implemented insofar as the transistor 52, and particularly its gate region, is located substantially beneath metallic conductors 60, 61 and in that the diode provided by region 66, which is especially photosensitive, is largely hidden by the mirror layer 65. Further details regarding the slug capacitance and the avoidance of photoconductive effects will be found in our copending International Patent Application PCT/GB99/04279 (ref: P20960WO).

While the fill factor of 65% in the arrangements of FIGS. 1 to 6 is sufficiently high to be acceptable, the reflectivity of the mirror electrode is not optimised, since the material thereof is identical to that used in producing the active elements of the backplane.

It is normal semiconductor foundry practice to supply backplanes with a continuous top insulating layer deposited over the entire plane, and to produce the arrangements of the preceding Figures, it would be necessary to remove this insulating layer, or to avoid having it applied in the first place.

However, by the use of partial or full planarisation of the backplane, the fill factor and reflectivity of the mirror electrode can be increased.

In partial planarisation the top insulating layer is retained, but with vias extending to underlying electrode pads 65, which can be small as they no longer function as mirrors. A respective highly reflective mirror coating is deposited over the majority of the pixel area and is connected to its via.

This construction has advantages, inter alia, of a high fill factor; a highly reflective mirror electrode; and reduced light penetration to the underlying semiconductor material. While it is preferred to retain the insulating columns and ridges to support and space the front electrode relative to the backplane, so reducing the fill factor slightly, these now include the additional top insulating layer. The only post-foundry step is the deposition of the reflective mirror material. It should be noted that the latter is not as flat as previously, owing to the underlying structure of the backplane.

Full planarisation is a known process in which the topology of the backplane is effectively removed by filling with a insulating material, e.g. a polymer. Again, this may be implemented on the present backplane, with or without the top insulating layer introduced at the foundry, and with very flat highly reflective mirror electrodes deposited over each pixel with a high fill factor. However, although the product has the same advantages as partial planarisation, and may be superior in performance, its production by present technologies involves a number of post-foundry steps, some not easily or efficiently performed (such as ensuring the flatness of the insulating material), and so is not preferred at the moment.

The chiral smectic liquid crystal material is given a desired surface alignment at one or both substrates by means known per se. In the case of the active semiconductor backplane, treatment will be of the partial or full planarisation layer if provided.

Circuitry The embodiment thus far described has a rectangular pixel array of 320 columns and 240 rows, the columns being supplied by parallel data lines and the rows being enabled to receive or act on the received data in turn in a desired sequence. The array is one half standard VGA resolution in each direction. It would be desirable to increase the resolution of the array to the VGA standard, and this is described later in respect to a modification Depending on the manner in which it is driven, and the value of the applied voltage, the present embodiment of a smectic liquid crystal spatial light modulator may be driven at a line rate of at let 10 MHz and a frame rate of up to 15 to 20 kHz, requiring a data input of around 1 to 1.5 Gpixel per second. Typically, while the pixel address time is around 100 nanoseconds, the pixel will actually take around 1 to 5 microseconds to switch between optical states; and while overall frame writing time is of the order of 24 microseconds, the frame to frame writing period is around 80 microseconds.

The disparity between the actual frame rate of the spatial modulator and the potential frame rate of the array (about 80 KHz) as determined by the line frequency, arises from a variety of factors such as the time necessary for the pixel elements to switch completely, (which is significantly greater than the line or pixel addressing time) and during which time charge is drawn from the cell capacitance and the slug capacitance; the need to blank the array to permit dc balancing; and optical access to the spatial light modulator between the writing of successive frames.

A master clock operates at 50 MHz. From the master clock pulses CL are derived in known manner the waveforms NTE, NTO, NISE, NISO, NC0 to NC5 shown in FIGS. 7 and 7*a*. The initial "N" indicates the use of negative logic in which signals are active in the low state. Where used, the inverse of these signals have the same terminology less the initial "N". The final letters "E" and "O" refer to even and odd, as applied to rows or columns of the array.

FIG. 8 illustrates parts of the control circuits 48 of FIG. 4. Here there are further signals NSAR and NRAR for setting all rows (to blank the array) and resetting all rows (to permit rewriting of the array) respectively.

FIG. 8(*a*) indicates the derivation of 5 non-overlapping clocks (N)CC0 to (N)CC4 at the 10 MHz line frequency from the signals NC0 to NC4 when the signal NSAR is inactive, for use in controlling the column drivers 42, 43.

As already indicated with respect to FIG. 4, a group of 32 incoming parallel data lines is 1:5 demultiplexed to the 160 even columns by driver 42 at the top of the array, and a complementary group of 32 incoming parallel data lines is 1:5 demultiplexed to the 160 odd columns by driver 43 at the foot of the array. Otherwise, drivers 42 and 43 are similarly arranged.

FIG. 9 shows one of 32 similar circuits of the driver 42, each for a respective single column in the first set of 32 even columns. A data signal DD from an input 131 coupled to a respective one of the 32 input data lines is transmitted by a gate 132 during the active period of clock NCC0 and held on the gate capacitor of an inverter 133 until a gate 134 controlled by clock pulse NCC4 permits transmission of the signal to a latch 135. Latch 135 is bistable and consists essentially of two inverters coupled in a ring via a flirter gate 136 also controlled by the gate pulse CC4, so that the ring is opened when the signal is being transmitted to the latch via the gate 134, and thereafter closed to hold the signal at the latch output. The output of the latch is connected to the column conductor via a level shifter 137 and two series coupled buffers 138.

This overall arrangement for the first set of column conductors is replicated for the remaining four sets, with the same 32 input data lines but with respective different clock signals NCC1 to NCC4 on the first gate 132 as appropriate. The signals applied to the gates 134 and 136 remain as NCC4 and CC4, so that data signals for a whole line are applied simultaneously to all 320 columns in response to the signal NCC4, and are maintained thereat until the next pulse NCC4.

When NSAR is active, it over-rides the clock pulses NCC0 to NCC4, making all 320 columns available to the 64 data input lines simultaneously.

FIG. 8(*b*) shows the derivation of 5 non-overlapping clocks (N)CR0 to (N)CR4 at the 10 MHz line frequency from the signals NC0 to NC4 when the signal NISE or NISO is inactive, for use in controlling the row drivers 44, 45.

As already described with respect to FIG. 4, even and odd rows of the array are driven (enabled) by respective scanners 44, 45, each comprising a shift register with associated level shifters at its outputs, or 120 adjacent outputs thereof. Each stage of the shift registers is fully bistable and controlled by clock pulses NCR0, NCR2 and NCR4. A single token pulse NTE, NTO is coupled into the first stage of the respective shift register at the start of each frame, and is then clocked down the register in the required manner, depending on the type of scanning required.

FIG. 10 shows a single stage of the odd row scanner 44 of the preferred embodiment, including an associated level shifter unit 141 of the level shifter 44*b* coupled between a single stage 140 of the shift register 44*a* and two buffers 149. The even row scanner 45 is arranged in a similar manner.

The stage 140 comprises a pair of inverting logic gates 143, 144 coupled in a ring via a transmission gate 145. The input 142 of logic gate 143 is commonly coupled to the output of the gate 145 and to the output of a transmission gate 146 which acts to receive the output 147 (token NTE) from a preceding stage in the register. Gates 145 and 146 are respectively enabled by inverse clock signals NCR0 and CRO, whereby the ring is broken as the signal from transmission gate 146 is passed to the input of gate 143, and subsequently reformed to maintain the inverse of the received signal at an output point 148.

Gates 143', 144', 145' and 146' are arranged in similar manner to the gates 143 to 146, and act similarly but in response to clock pulses NCR4, CR4, whereby the inverse of the signal at point 148 is held at output point 148', where it is level shifted by circuit 121 and transmitted to the respective row. Thus each row is enabled in turn in response to the signal NCR4.

Each of gates 143, 144 and 144' is a NAND gate with two inputs, and the gate 143' is a NAND gate with 3 inputs. The second input to gates 143 and 144' is the signal NSAR, the second input to gates 143' and 144 is the signal NRAR, and the third input to gate 143' is a signal NCR2'. When signals NSAR, NRAR and NCR2' are inactive, the gates act as inverters and the rings are bistable.

The signal NCR2' is derived as shown in FIG. 8(*c*). It is similar to signal NCR2 but is over-ridden when signal NSAR is active. When NSAR is inactive, the effect of the clock signal NCR2 is to ensure that the second ring is reset and the row disabled before the following row is enabled, thus ensuring that data supply is to a single row, and that there can be no overlap of the same data between rows.

The control signal NSAR acts to disable the signal NCR2' and to set (latch) all outputs of the register, thereby enabling all rows for blanking in the manner described at the commencement of this section. The control signal NRAR subsequently acts to turn all the rows off again. Thus the signal NSAR over-rides the normal operation of the shift registers.

The action of the signal NSAR is thus (a) to over-ride the column clocks NCC0 to NCC5 so that all five sets of columns are simultaneously provided with data from the 64 data inputs, and (b) to disable the clock pulse NCR2' and the normal action of the register, and to latch all rows. This permits the entire array of pixels to be blanked simultaneously.

Other than when the tokens NTO and NTE are first introduced, the signals NISE and NISO are complementary. When active, their action is to inhibit the production of the row clock pulses (N)CR0 to (N)CR4, FIG. 8(*b*). In this manner only one of the shift registers 44*a*, 44*b* is active at any one time, making it possible to control the manner in which the tokens are passed down the rows. For example, if, as shown, NISE and NISO are derived so as to have one half line frequency, the registers are enabled alternately to provided a progressive or non-interlaced line scan down the array. An alternative would be to provide signals NISE and NISO in the form of pulses of one half the frame address period, so that the one register is completely scanned and then the other register is completely scanned, thus providing an interlaced scan.

Other modes are possible, for example enabling an adjacent odd and even row simultaneously, giving twice the frame rate but at half the vertical resolution.

Although in this embodiment the shift register stages are adapted to provide directly for a response to the signals NSAR and NRAR, it will be clear that alternative means could be provided as a separate entity between the registers and the rows, for example an OR gate for NSAR and an AND gate for NRAR coupled in series between a register output and the associated row.

VGA Resolution In a modification of the present embodiment, the single pixel mirror and active element is replaced by a group of four (two by two), with a corresponding doubling of the row and column address lines. To accommodate the doubling of the address lines in each dimension, the column drivers and row scanners are provided with 1:2 demultiplexers.

The column circuits are merely doubled in number, each pair being enabled in alternation by transmission gates 150, 151, with complementarily driven control inputs 152, 153 as illustrated schematically in FIG. 11.

Figure 12A:
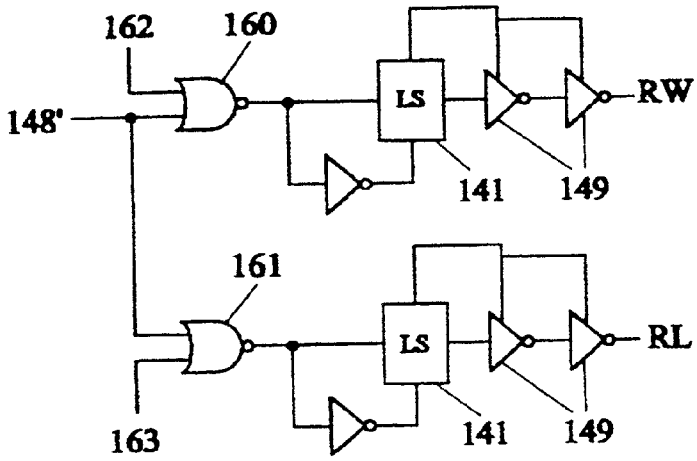
Figure 12B:
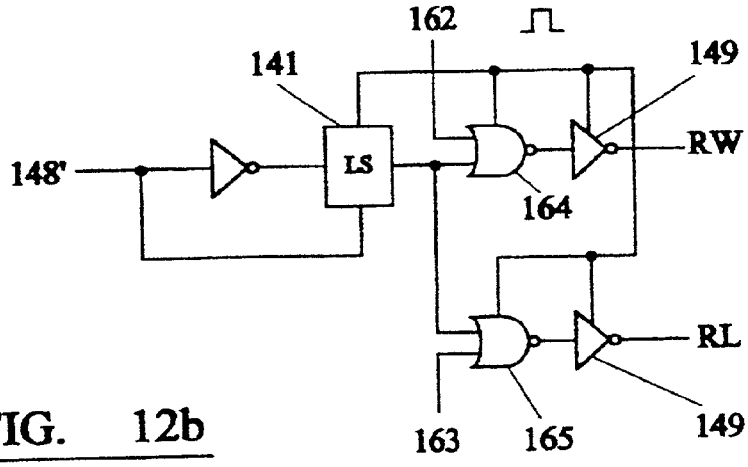
Figure 12C:
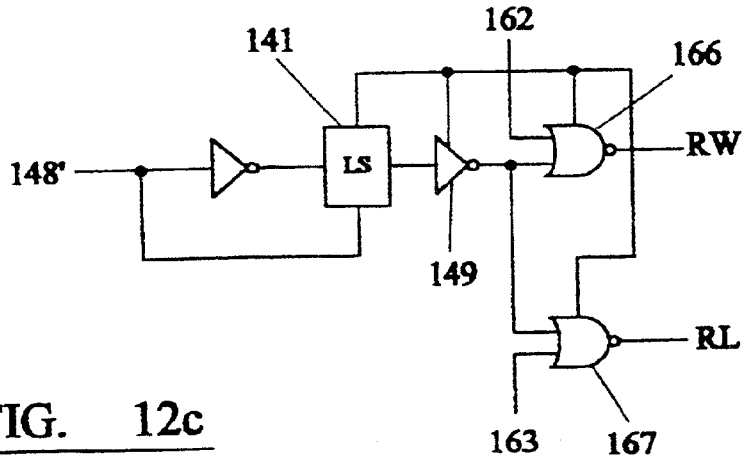

FIGS. 12*a* to 12*c* illustrate three possible schemes for the row scanners. In the preferred scheme of FIG. 12*a*, logic gates 160, 161 are disposed between the output point 148' and respective level shifters 141 and buffers 149. Second inputs 162, 163 of the gates are driven in complementary fashion to enable either the upper or lower pair of pixels (RW and RL).

However, as schematically shown in FIGS. 12*b* and 12*c*, the demultiplexing may be performed after the level shifter 141, respectively at gates 164, 165 between the level shifters 141 and final output stages 149', or at gates 166, 167 which also constitute the final output stage.

It will be clear that by suitable control of the signals 152 and 153, and or 162 and 163 various other modes of writing the array will be possible, for example 4:1 row interlace schemes.

In this modification, the ratio of mirror area to pixel area is reduced, and care needs to be taken to shield the underlying active elements from incident light. The ratio of total pixel capacitance to liquid crystal cell capacitance is also somewhat reduced, from 10:1 to 8.4:1. Nevertheless, the trade-off with increased resolution is considered overall not to-be disadvantageous.

Operation Spatial light modulation provides opportunities both in optical processing, for example in holographic and switching applications, where requirements are commonly very stringent in terms of factors such as timings, continuity of illumination, length of viewing, etc. Set against this, most optical processing requires only binary modulation across the image plane.

For display purposes, accommodation and temporal averaging by the eye permits more latitude in respect of the foregoing factors, but it is very commonly necessary to provide a grey scale modulation across the area of the display.

There are many ways in which the spatial light modulator of the preferred embodiment may be driven, due in part to the versatility afforded by the active backplane design.

(a) Binary/Grey Scale Thus, for example, there is a choice between binary and grey scale modulation. Grey scale modulation itself may be achieved either in an analogue manner by suitable control of the amplitude voltage applied across each pixel (of the electroclinic effect mentioned earlier), but advantageously for display purposes the array is subject to variable temporal modulation to provide an apparent grey scale. Even more advantageously, the array is so driven on a digital basis. This aspect is covered in more detail in our copending Intentional Patent Applications PCT/GB99/04260 and PCT/GB99/04277.

(b) Multiple Refresh Again, the liquid crystal material may or may not possess a relaxation time of sufficient length to cover the desired time between the production of successive images. Where it does not, the image will need to be written more than once to obtain the desired time. The high writing speed available with the embodiment is useful in this respect, in increasing the proportion of the total time in which an image is available.

(c) Front Electrode Voltage Furthermore, and broadly, the voltage applied between the common front electrode and the active backplane elements may be managed in at least two ways. Assuming that the overall voltage available from the backplane is V, it is possible to set the front electrode at V/2 whereby all pixel elements can be turned on or off as desired during a single frame scan. The penalty is the application of a lower voltage V/2 across each pixel and longer switching times, inter alia.

Alternatively, the front electrode can be driven alternately to V and zero, with the backplane being synchronously controlled so as to turn selected pixels optically on during one frame scan and to turn other selected pixels optically off during the other frame scan. The voltage applied to each pixel is higher, at, V, thus increasing switching speed, but with the need to perform two frame scans to complete data entry.

These two methods will henceforth be termed "on-pass" and "two-pass" respectively. In the embodiment, the one-pass scheme permits a somewhat higher frame rate at the greatest usable voltages.

These, and other considerations such as whether to achieve overall dc balancing (and, if so, the time period over which dc balancing is to be achieved), will determine exactly how the spatial light modulation is operated.

One Pass Scheme FIG. 13 illustrates voltage waveforms which can be used in a one pass scheme when the front electrode voltage VFE is at V/2. The voltage Vpad at mirror electrodes of pixels DUP in an addressed line which are to be turned from off to on are driven to a value V from the column electrodes, and for pixels UDP which are to be turned from on to off the mirror electrodes are driven to zero voltage. The resulting voltage across the liquid crystal cell is VLC. Energisaton typically takes around 10 ns, although 100 ns is actually allowed in the embodiment. A significantly longer period T is allowed for the pixels actually to switch, following which all pixel electrode voltages (Vpad) are returned to voltage V/2 by altering the voltage to the level shifters and either performing a second scan or a set/reset operation using the signals NSAR and NRAR to gate all pixel transistors on and off, as shown in FIG. 13*a*. Returning the pixels to V/2 ensures that the length of application of dc is well defined and repeatable.

In FIGS. 13*a* and 13*b*, pulse 131 denotes selection of an individual row, $T_L$ denotes the time to load the array (including a period for the liquid crystal to settle), and $T_R$ is the time over which the image is read, the start only of this period being shown. Pulse 132 denotes either selection of an individual row during a second scan, or a global row select for the set/reset option.

The set/reset option is faster, and is preferred. While the length of application of dc to all pixels differs from row to row when using the set/reset option, due to the finite time taken to write the array, this is immaterial since the length of application of dc pulses to the same pixel is equal from frame to frame, and this is the important factor when contemplating dc balance. In either case, the transistor is subsequently turned off, permitting electrostatic stabilisation (see later).

Since all pixels are energised during each frame scan, liquid crystal elements which remain the same from frame to frame are repeatedly driven in the same direction, and this can give rise to problems in obtaining a zero dc balance.

Furthermore, returning all pixel electrodes to V/2 can give rise to problems where photoconduction is significant. In such a case, it is preferred to gate all pixel electrodes to zero volts synchronously with a return of the front electrode voltage VFE to zero volts subsequent to writing the frame, as shown in FIG. 13*b*.

Two-Pass Scheme FIG. 14 shows voltage waveforms which could be used in a two-pass scheme, over the two frame scan periods or passes P1 and P2 necessary to write the whole array. In the first pass P1, selected pixels are addressed to turn them optically on, in the second pass pixels P2 are addressed to turned them optically off. For periods outside the passes all voltages are zero dc, optionally with a low level ac voltage for ac stabilisation of the switched states.

Plot (i) shows the voltage VFE at the front electrode, which is raised to V volts only for the duration of the second pass P2.

Plots (ii) and (iii) are plots of the voltage Vpad at pixel mirror pads respectively being turned ON or OFF. During the first pass any pad may be switched from zero volts to V volts. A first global blank BV is applied to drive all mirror pads to V volts between the two passes. During the second pass any pad may be switched from V volts to zero volts. A second global blank B0 is applied to drive all pads to zero volts at the end of the second pass. Blanks BV and B0 are applied in substantial synchronism with the switching of the second electrode.

Plot (ii) shows the voltage at a pad for a selected pixel which is to be turned on during the row scanning of the first pass, so providing a positive potential difference pulse across the associated liquid crystal element as shown in plot (iv). After the first pass the first global blank BV in association with the switching of VFE acts to reduce the potential difference across all liquid crystal elements to zero regardless of whether they have been switched or not, with both sides of the liquid crystal cells now at V volts.

Plot (iii) shows the voltage at a pad for a selected pixel which is to be turned off during the row scanning of the second pass, so providing a negative potential difference across the associated liquid crystal element as shown in plot (v). After the second pass the second global blank B0 in association with the switching of VFE acts to reduce the potential difference across all liquid crystal elements to zero regardless of whether they have been switched or not, with both sides of the liquid crystal cells now at zero volts.

Any pixel which (as an option) is not addressed during either pass, has a pad voltage which is due solely to the effect of the blanks BV and B0. BV and B0 are substantially synchronous with the switching of VFE, so that these pixels experience zero potential difference throughout the two passes. In all cases the timing of BV and B0 relative to VFE must be such that no unwanted switching of pixels occurs.

Furthermore, although the two passes have been shown as immediately succeeding one another, as is preferred, this is not entirely necessary so long as the scheme is consistent with the required pixel switchings. For example, there could be a small delay between the passes to enable the last addressed pixels to switch completely. In such a case it would be desirable to apply BV and the switching of VFE synchronously with the commencement of the second pass.

For further explanation, FIG. 15 shows simplified voltage waveforms which could be used in a similar two-pass scheme, over first and second frame scan periods or passes P1 and P2 necessary to write the whole array. In P1, selected pixels are addressed to turn them optically on, in P2 pixels are addressed to turned them optically off. For periods outside P1 and P2 all voltages are zero dc, optionally with a low level ac voltage for ac stabilisation of the switched states.

Plot (i) shows the voltage VFE at the front electrode, which is raised to V volts only for the duration of P2.

Plot (ii) is a general plot of the voltage Vpad obtainable at any pixel mirror pad. During a first period A during P1 any pad may be switched from zero volts to V volts. A first global blank BV is applied to drive all mirror pads to V volts between P1 and P2. During a period B during the P2 any pad may be switched from V volts to zero volts. A second global blank B0 is applied to drive all pads to zero volts at the end of the second pass. Blanks BV and B0 are applied in synchronism with the switching of the second electrode.

Plot (iii) shows the voltage at a pad for a selected pixel which is to be turned on during the row scanning of P1, so providing a positive potential difference pulse across the associated liquid crystal element as shown in plot (iv). After P1 the first global blank BV in association with the switching of VFE acts to reduce the potential difference across all liquid crystal elements to zero regardless of whether they have been switched or not, with both sides of the liquid crystal cells now at V volts.

Plot (v) shows the voltage at a pad for a selected pixel which is to be turned off during the row scanning of P2, so providing a negative potential difference across the associated liquid crystal element as shown in plot (vi). After P2 the second global blank B0 in association with the switching of VFE acts to reduce the potential difference across all liquid crystal elements to zero regardless of whether they have been switched or not, with both sides of the liquid crystal cells now at zero volts.

Plot (vii) shows the voltage pulse at a pad for any pixel which (as an option) is not addressed during either P1 or P2, and which is due solely to the effect of the blanks BV and B0. BV and B0 are substantially synchronous with the switching of VFE, so that these pixels experience zero potential difference throughout the two passes. In all cases the timing of BV and B0 relative to VFE must be such that no unwanted switching of pixels occurs.

Furthermore, although P1 and P2 have been shown as immediately succeeding one another, as is preferred this is not entirely necessary so long as the scheme is consistent with the required pixel switchings. For example, there could be a small delay between P1 and P2 to enable the last addressed pixels to switch completely. In such a case it would be desirable to apply BV and the switching of VFE synchronously with the commencement of P2.

It will be appreciated that the requirement for two passes and the application of the full available voltage V are counteracting factors, compared with the single pass and lower voltage V/2 (and therefore slower switching) of the single pass scheme. It should also be evident that it is possible to reverse the sequence of P1 and P2 of FIGS. 14 or 15, with consequential modification of the blanking processes, etc. This is shown in FIG. 16 in respect of FIG. 15 and using the same schematic type of illustration with corresponding references.

Binary Imaging. A binary image may be written from a blank image or an existing image, by a 1-pass method as has been described above However, from a blank image, writing a new image and subsequently reversing the voltages applied to each respective pixel to achieve dc balance does not result in reversion of the optical image to a blank one, but to a reverse optical image. In addition, the time averaged optical image is zero if the positive and reverse images are held for equal times, so it may well be necessary to interrupt the illumination (or the viewing step) in order to see a positive image.

Furthermore, merely allowing the addressed pixels to relax, or driving all pixels to one state (relatively fast), for example by applying the global set signal NSAR to the array together with control of the column and front electrode voltages so as to short all pixels (zero volts) or drive them (plus or minus V), does not provide dc balance, although an optically uniform image results.

There are similar difficulties if starting with an existing image.

A two-pass scheme, for example of the type illustrated in FIG. 14, can be operated in a number of ways.

In a first two-pass scheme, an existing image may be replaced by a new image simply by turning all appropriate pixels on during the first pass, and by turning the complementary set of pixels off during the second pass (as in FIG. 14), i.e. all "1"s in the new image are first addressed, regardless of whether the pixel is already "1", and subsequently all "0"s in the new image are addressed regardless of whether the pixel is already "0". No pixel is unaddressed.

This scheme suffers from the same drawback as the single pass scheme that all pixels are addressed for each image regardless of their existing state, and dc balance is not directly effected. However, it is computationally easy and fast.

In a second two-pass scheme, any liquid crystal element is only driven on or off when a change of state therein is required, otherwise it remains unaddressed. Each pixel is therefore subjected only to alternate tun-on and turn-off pulses of well-defined and equal lengths, thus automatically affording dc balance in the long term.

For this scheme to work successfully over an extended period, it is necessary that the pixels are not allowed to relax between successive energisations, for example by application of ac stabilisation between scans as mentioned above.

The advantage of automatic long term dc balance is partially offset by increased computational difficulty relative to the first two-pass scheme.

A third and preferred scheme, which is a modification of the two-pass scheme of FIG. 14, and which is illustrated in FIG. 17, enables a series of binary images to be written in succession, with dc balance, and with fast or driven erasure. Plots (iii) and (iv) of FIG. 17 illustrate mirror pad voltages and pixels potential differences for a pixel which is selected.

During a first WRITE period t0 to t1, a first image is written from a blank array of elements, by controlling the writing process so that only those elements which need to be turned on are driven (during the period A of plot (ii)), all other elements receiving zero volts. While similar to the first pass of two pass scheme of FIG. 14, the WRITE step is followed, preferably immediately at time t1, by a first global blank B0 to zero volts, and VFE remains at zero volts, as a shown in plot (i) of FIG. 17. For an IMAGE period t1 to t2 the required binary image remains unaltered.

Subsequent erasure to a blank array is then effected during an ERASE period t2 to t3 by writing the negative image to the written pixels only. This is effected by applying a second global blank BV to V volts at time t2, synchronously with switching of VFE, and then during a period B addressing only those elements which were previously turned on, the other elements again receiving zero volts. At t3, a third global blank B0 to zero volts is applied synchronously with switching to zero volts of VFE. The erasure step is therefore generally similar to the second pass of FIG. 14.

Thus, the driven elements alternately receive opposed voltages to provide dc balance, and the other unselected elements receive no voltage and so remain balanced.

After time t3 it is possible to commence the writing of another binary image, and, as illustrated, this may commence substantially at time t3.

Thus, this third two-pass scheme resembles the second two-pass method in that the fill voltage V can be applied in different directions during the two passes of writing and erasure, but differs therefrom in that it is the same group of selected pixels which are addressed each time rather than different non-complementary groups, so reducing computational requirements. It differs from the one-pass method in which all elements are necessarily driven one way or the other during the frame scan.

An advantage of this third scheme is that the time averaged image is non-zero, regardless of the lengths of the writing, erasing and "viewing" processes, since it alternates between image and blank rather than image and inverse image, and this permits optical illumination to be continuous.

A further consideration is that while the writing stage may be followed by a period of time during which the image is "viewed" or utilised, there is no need to hold the blank image obtained after erasure for any length of time. As particularly illustrated in FIG. 17, once all the pixels have switched back to their initial state, a further writing stage may commence immediately. Since the ratio of the IMAGE period to the WRITE and ERASE periods times may be large, the image is available for a large fraction of the total time, and its contrast ratio is correspondingly improved.

Although the above and other imaging schemes herein have been illustrated as employing global blanks, it should be noted that any or all of the blanks could be replaced by a further frame scan in which all columns are held at the blanking voltage. These schemes form the subject of our copending International Patent Application PCT/GB99/04275 (ref: P20962WO).

It should be understood that although much of the description above is in terms of a liquid crystal cell incorporating a backplane which includes an addressable array, the array of the invention may be used in any cell construction irrespective of whether or not the cell is intended to function as a light modulator or display, and irrespective of whether or not the contents of the cell arm intended to have a liquid crystal phase.

Although the term "grey scale" is used herein, it should be made clear that the term is used in relation to any colour, including white. Furthermore, although the methods, arrays, backplanes, circuitry etc. of the invention are described in relation to a single, colour, including white, it is envisaged that variable colour displays etc. will be produced in manners known per se, such as by spatially subdividing a single array into different colour pixels, superimposing displays from differently coloured monochrome arrays for example by projection, or temporal multiplexing, for example sequential projection of red green and blue images.

The invention claimed is:

1. An active backplane arrangement comprising an array of electrically-addressable elements defined on an active backplane, said array comprising:

a first plurality of mutually exclusive sets of said elements;

set scanning means arranged to address all said sets of the first plurality one set at a time in a predetermined order;

set selecting means for selectively addressing each said set independently of said set scanning means whereby more than one, or all, of said first plurality of sets may be addressed simultaneously.

2. An arrangement according to claim 1 wherein said set scanning means comprises at least one shift register having a plurality of stages, each said set being coupled to the output of a respective stage.

3. An arrangement according to claim 2 wherein said set selecting means comprises a first control input on each said stage of the shift register(s) for latching its output.

4. An arrangement according to claim 3 wherein each said stage also comprises a second control input for de-latching or resetting it to permit normal shift register operation to resume.

5. An arrangement according to claim 3 and wherein said set selecting means includes means for providing an input signal to selected said first input(s), together with a signal for inhibiting normal shift register operation.

6. An arrangement according to claim 3 wherein said set selecting means comprises logic between each said output and its said set, said logic having a first control input for providing a predetermined first signal which over-rides the said output.

7. An arrangement according to claim 6 wherein said logic also comprises a second control input for providing a predetermined second signal different to the first signal which second signal over-rides the said output.

8. An arrangement according to claim 7 wherein the logic is arranged such that one of said first and second signals over-rides the other.

9. An arrangement according to claim 2 wherein each said output is followed by a demultiplexer.

10. An arrangement according to claim 1 wherein said array comprises a further plurality of mutually exclusive sets of said elements, a second said set scanning means for said further plurality, and a second set selecting means for said further plurality.

11. An arrangement according to claim 1 wherein the set scanning means is/are driven by clock signal(s).

12. An arrangement according to claim 10 wherein said arrangement comprises means for generating said clock signal(s) and means arranged for transferring said clock signal(s) to only one set scanning means at a time.

13. An arrangement according to claim 12 wherein said transfer means is arranged or controllable so as to transfer said clock signal(s) alternately to each of said first and second set scanning means at a rate such that odd and even sets are addressed alternately one set at a time.

14. An arrangement according to claim 12 wherein said transfer means is arranged or controllable so as to transfer said clock signal(s) to one of said set scanning means for a duration permitting all its sets to be addressed, and subsequently to transfer said clock signal(s) to the other of said set scanning means for a duration permitting all its sets to be addressed.

15. An arrangement according to claim 1 wherein said elements are arranged as rows and columns, and said sets are constituted by said rows.

16. An arrangement according to claim 10 wherein said first plurality is constituted by odd rows, and said further plurality is constituted by even rows.

17. An arrangement according to claim 1 wherein said elements have first and second addressable inputs, the first inputs being addressable by the set scanning and set selecting means, and wherein the arrangement comprises means for addressing the second addressable inputs of a plurality of said columns simultaneously.

18. An arrangement according to claim 17 wherein said plurality is constituted by all the columns of the array.

19. An arrangement according to claim 17 and comprising 1:n demultiplexing means coupled to a plurality of data input lines for sequentially latching n successive like pluralities of column outputs with sequentially supplied data from said input lines, said column outputs being coupled to said second addressable inputs.

20. An arrangement according to claim 19 wherein said demultiplexing means includes a control input for overriding the demultiplexing function and for latching all of the pluralities of column outputs with the same data from said input lines.

21. An arrangement according to claim 1, wherein said active backplane is a semiconductor backplane.

22. An arrangement according to claim 1 wherein said backplane includes spacers located and distributed thereover, and the spacers extend above the electrically-addressable elements and comprise at least two layers essentially of the said material and occurring in the same order as is found in at least one of the electrically-addressable elements.

23. An arrangement according to claim 1 wherein each electrically-addressable element of said backplane comprises a single transistor associated with a capacitance.

24. An arrangement according to claim 1 wherein each said electrically addressable element comprises a bistable electrical circuit.

25. A spatial light modulator comprising an arrangement according to claim 1, each said electrically addressable element of the array providing a pixel.

26. A spatial light modulator according to claim 25 wherein the array of electrically addressable elements is spaced from an opposed substrate, with electro-optic material disposed between the array and the substrate.

27. A spatial light modulator according to claim 26 wherein the opposed substrate provide a counterelectrode to an element of the array.

28. A spatial light modulator according to claim 26 wherein the electro-optic material is a liquid crystal material.

29. A spatial light modulator according to claim 28 wherein the electro-optic material is a smectic liquid crystal material.

30. A spatial light modulator according to claim 28 wherein the electro-optic material is a chiral smectic liquid crystal material.

31. A method of operating a spatial light modulator as defined in claim 25 including the step of applying the same field to every pixel.

32. A method of operating a spatial light modulator as defined in claim 25, wherein said elements of said array are arranged as rows and columns, and said sets are constituted by said rows, said method comprising the step of applying the same signal to each column and addressing more than one of said rows simultaneously.

33. A method according to claim 32 wherein all of said rows are addressed simultaneously.

34. A method according to claim 31 wherein the field applied to each pixel during said step is zero.

35. A method according to claim 31 wherein the field applied to each pixel during said step is an ac field.

36. A method according to claim 31 wherein the field applied to each pixel during said step is a finite de field.

37. An active backplane arrangement comprising an array of electrically-addressable elements defined on an active backplane, said array comprising:

a first plurality of mutually exclusive sets of said elements;

set scanning circuitry arranged to address all said sets of the first plurality one set at a time in a predetermined order; and set selecting circuitry for selectively addressing each said set independently of said set scanning circuitry whereby more than one, or all, of said first plurality of sets may be addressed simultaneously.

* * * * *